US010100606B2

(12) United States Patent
Langlais

(10) Patent No.: US 10,100,606 B2
(45) Date of Patent: Oct. 16, 2018

(54) SYSTEM AND METHOD FOR GRAVEL PACKING A WELLBORE

(71) Applicant: Schlumberger Technology Corporation, Sugar Land, TX (US)

(72) Inventor: Michael Langlais, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 472 days.

(21) Appl. No.: 14/698,555

(22) Filed: Apr. 28, 2015

(65) Prior Publication Data

US 2015/0308238 A1 Oct. 29, 2015

Related U.S. Application Data

(60) Provisional application No. 61/991,160, filed on May 9, 2014, provisional application No. 61/985,289, filed on Apr. 28, 2014.

(51) Int. Cl.

| | |
|---|---|
| ***E21B 34/06*** | (2006.01) |
| ***E21B 43/08*** | (2006.01) |
| ***E21B 43/12*** | (2006.01) |

(52) U.S. Cl.

CPC ..... *E21B 34/06* (2013.01); *E21B 43/08* (2013.01); *E21B 43/12* (2013.01)

(58) Field of Classification Search

CPC ..... E21B 34/063; E21B 43/04; E21B 43/045
See application file for complete search history.

(56) References Cited

U.S. PATENT DOCUMENTS

| | | | | |
|---|---|---|---|---|
| 4,428,428 | A * | 1/1984 | Smyrl | E21B 34/063 166/278 |
| 6,176,307 | B1 * | 1/2001 | Danos | E21B 43/04 166/276 |
| 6,371,210 | B1 | 4/2002 | Bode et al. | |
| 6,505,682 | B2 | 1/2003 | Brockman | |
| 6,622,794 | B2 | 9/2003 | Zisk et al. | |
| 7,100,686 | B2 | 9/2006 | Wittrisch | |
| 7,185,706 | B2 | 3/2007 | Freyer | |
| 7,290,606 | B2 | 11/2007 | Coronado et al. | |

(Continued)

FOREIGN PATENT DOCUMENTS

WO 2013187878 A1 12/2013

OTHER PUBLICATIONS

PCT/US2015/028010, International Search Report and Written Opinion, dated Aug. 6, 2015, 13 pgs.

(Continued)

*Primary Examiner* — Shane Bomar

(57) ABSTRACT

A downhole tool includes a housing having a screen. An inner tubular member is positioned radially-inward from the housing such that an annulus is formed therebetween, and a first opening is formed radially-through the inner tubular member. A valve is positioned within the annulus. A flow control device is positioned within the annulus. A degradable member is configured to at least partially degrade in response to contact with a fluid. The valve is configured to actuate from a first position to a second position in response to the degradable member at least partially degrading. This changes a proportion of the fluid that flows through the flow control device after entering through the screen.

24 Claims, 21 Drawing Sheets

(56) References Cited

U.S. PATENT DOCUMENTS

| | | | | |
|---|---|---|---|---|
| 7,409,999 | B2 | 8/2008 | Henricksen et al. | |
| 7,523,787 | B2 | 4/2009 | Richards et al. | |
| 7,708,068 | B2 | 5/2010 | Hailey, Jr. | |
| 7,789,145 | B2 | 9/2010 | Patel | |
| 7,828,067 | B2 | 11/2010 | Scott et al. | |
| 7,971,642 | B2 | 7/2011 | Yeh et al. | |
| 7,984,760 | B2 | 7/2011 | Haeberle et al. | |
| 7,987,909 | B2 | 8/2011 | Pineda et al. | |
| 8,127,831 | B2 | 3/2012 | Haeberle et al. | |
| 8,453,746 | B2 | 1/2013 | Hailey, Jr. et al. | |
| 8,485,265 | B2 | 7/2013 | Marya et al. | |
| 8,622,125 | B2 | 1/2014 | Weirich et al. | |
| 2002/0079099 | A1 | 6/2002 | Hurst et al. | |
| 2003/0111224 | A1 | 6/2003 | Hailey, Jr. | |
| 2004/0020832 | A1* | 2/2004 | Richards | E21B 34/06 210/106 |
| 2004/0140089 | A1 | 7/2004 | Gunneroed | |
| 2005/0072576 | A1 | 4/2005 | Henricksen et al. | |
| 2005/0082060 | A1 | 4/2005 | Ward et al. | |
| 2006/0042798 | A1 | 3/2006 | Badalamenti et al. | |
| 2006/0073986 | A1* | 4/2006 | Jones | C09K 8/36 507/129 |
| 2007/0044962 | A1 | 3/2007 | Tibbles | |
| 2007/0246213 | A1 | 10/2007 | Hailey, Jr. | |
| 2008/0283238 | A1 | 11/2008 | Richards et al. | |
| 2008/0314589 | A1 | 12/2008 | Guignard et al. | |
| 2009/0008078 | A1 | 1/2009 | Patel | |
| 2009/0101354 | A1 | 4/2009 | Holmes et al. | |
| 2009/0151925 | A1 | 6/2009 | Richards et al. | |
| 2010/0032158 | A1 | 2/2010 | Dale et al. | |
| 2010/0059232 | A1 | 3/2010 | Langlais et al. | |
| 2011/0011586 | A1 | 1/2011 | Dusterhoft et al. | |
| 2011/0073308 | A1 | 3/2011 | Assal et al. | |
| 2011/0094742 | A1 | 4/2011 | Badalamenti et al. | |
| 2011/0139465 | A1* | 6/2011 | Tibbles | E21B 33/124 166/387 |
| 2011/0198097 | A1 | 8/2011 | Moen | |
| 2011/0203793 | A1 | 8/2011 | Tibbles | |
| 2011/0239754 | A1 | 10/2011 | Dyer et al. | |
| 2011/0303420 | A1 | 12/2011 | Thorkildsen et al. | |
| 2012/0067588 | A1 | 3/2012 | Awid et al. | |
| 2012/0305243 | A1 | 12/2012 | Hallundbaek et al. | |
| 2013/0014953 | A1 | 1/2013 | Van Petegem | |
| 2013/0081800 | A1 | 4/2013 | Riisem et al. | |
| 2013/0092394 | A1 | 4/2013 | Holderman et al. | |
| 2013/0139465 | A1 | 6/2013 | Kuryk et al. | |
| 2013/0228341 | A1 | 9/2013 | Fripp et al. | |
| 2013/0319664 | A1 | 12/2013 | McNamee et al. | |
| 2014/0014357 | A1 | 1/2014 | Riisem | |
| 2015/0027700 | A1* | 1/2015 | Riisem | E21B 43/04 166/278 |
| 2015/0198016 | A1 | 7/2015 | Langlais | |
| 2015/0308239 | A1 | 10/2015 | Langlais | |

OTHER PUBLICATIONS

PCT/US2015/027997, International Search Report and Written Opinion, dated Aug. 7, 2015, 13 pgs.

PCT/US2014/066028, International Search Report and Written Opinion, dated Feb. 24, 2015, 10 pgs.

PCT/US2014/048139, International Search Report and Written Opinion, dated Nov. 13, 2014, 15 pgs.

European Search Report for corresponding EP Application Serial No. 15785240.1, dated Nov. 22, 2017, 9 pages.

Office Action for corresponding Russian Application Serial No. 2018146216/03, dated Jul. 24, 2017, 9 pages.

Office Action for related Russian Application Serial No. 2016146220/03, dated Aug. 14, 2017, 8 pages.

Aviles, et al., "Degradable Frac Ball Holds Solution to Persistent Problem in Fracturing", Journal of Petroleum Technology; Society of Petroleum Engineers, Nov. 2013, pp. 32-33.

Schlumberger, "Elemental Degradable Technology", http://www.slb.com/services/completions/completion_products/multistage_stimulation_systems/elementals.aspx, 2013, 3 pages.

Schlumberger, "Elemental Degradable Technology Frac Balls", slb.com/elemental, 2013, 2 pages.

European Extended Search Report for related Application Serial No. 15785259.1, dated Nov. 22, 2017, 6 pages.

* cited by examiner

SYSTEM AND METHOD FOR GRAVEL PACKING A WELLBORE

CROSS-REFERENCE TO RELATED APPLICATIONS

This application claims priority to U.S. Provisional Patent Application having Ser. No. 61/985,289, filed on Apr. 28, 2014, entitled "System and Method for Obstructing a Flowpath in a Wellbore," to Michael Langlais. This application also claims priority to U.S. Provisional Patent Application having Ser. No. 61/991,160 filed on May 9, 2014, entitled "Three Stage Valve for Gravel Packing a Wellbore," to Michael Langlais and Bryan Stamm. The disclosures of both applications are incorporated by reference herein in their entirety.

FIELD

Embodiments described herein generally relate to downhole tools. More particularly, such embodiments relate systems and methods for obstructing or controllably restricting a flowpath in a wellbore.

BACKGROUND INFORMATION

A completion assembly is oftentimes run into a wellbore before the wellbore begins producing hydrocarbon fluids from the surrounding formation. The completion assembly may include a base pipe and a screen disposed thereabout. The base pipe may have one or more openings formed radially therethrough. The openings may have nozzles disposed therein, each having an inner diameter from about 1.5 mm to about 4 mm. These openings with the nozzles disposed therein are referred to as inflow control devices ("ICDs") and are designed to control the rate of the hydrocarbon fluids flowing into the base pipe and up to the surface.

Once the completion assembly is in place in the wellbore, an annulus between the completion assembly and the wellbore wall may be packed with gravel prior to producing the hydrocarbon fluids from the surrounding formation. To gravel pack the annulus, a gravel slurry is pumped from the surface down through the annulus. The gravel slurry includes a plurality of gravel particles dispersed in a carrier fluid. When the gravel slurry reaches the screen in the completion assembly, the carrier fluid flows radially-inward through the screen, leaving the gravel particles in the annulus to form a "gravel pack" around the screen. The carrier fluid then flows into the base pipe and up to the surface. As the gravel slurry may be pumped into the annulus at about 5-10 barrels per minute, the inflow control devices may not provide a large enough cross-sectional area for the carrier fluid to flow through to the base pipe.

To increase the cross-sectional area through which the carrier fluid may flow, one or more additional openings may be formed in the base pipe. The additional openings may be axially-offset from the screen and/or the ICDs. Once the gravel packing process is complete, the flowpath through annulus to the additional openings is obstructed to allow the ICDs to control the flow rate of the hydrocarbon fluids into the base pipe. The flow path may be obstructed by expanding a swellable elastomeric device disposed between the base pipe and a non-permeable housing positioned radially-outward therefrom. The elastomeric device may expand due to contact with a fluid for a predetermined time. The elastomeric devices, however, sometimes expand prematurely (i.e., before gravel packing is complete) due to contact with fluid during manufacture, transport, storage, or while being run into the wellbore. The elastomeric devices may also lose contact pressure during downhole temperature shifts or swell undesirably later in production.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool is disclosed. The downhole tool includes a housing that includes a screen. An inner tubular member is positioned radially-inward from the housing such that an annulus is formed therebetween, and a first opening is formed radially-through the inner tubular member. A valve is positioned within the annulus. A flow control device is positioned within the annulus. A degradable member is configured to at least partially degrade in response to contact with a fluid. The valve is configured to actuate from a first position to a second position in response to the degradable member at least partially degrading, thereby changing a proportion of the fluid that flows through the flow control device after entering through the screen.

In another embodiment, the downhole tool includes a housing that includes a screen. An inner tubular member is positioned radially-inward from the housing such that an annulus is formed therebetween, and a first opening is formed radially-through the inner tubular member. A valve is positioned within the annulus between the screen and the first opening. The valve includes an intermediate tubular member having a second opening formed radially-therethrough. The valve also includes a body positioned at least partially within the intermediate tubular member, and a third opening is formed radially-through the body. A flow control device is positioned within the body. A degradable member is configured to at least partially degrade in response to contact with a fluid. The valve is configured to actuate from a first position to a second position in response to the degradable member at least partially degrading, thereby changing a proportion of the fluid that flows through the screen that flows through the flow control device.

A method for gravel packing a wellbore is also disclosed. The method may include degrading a degradable member in a downhole tool. The downhole tool includes a screen and a valve. The valve actuates in response to the degradable member at least partially degrading. This changes a proportion of fluid that flows through a flow control device after entering through the screen.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1A:
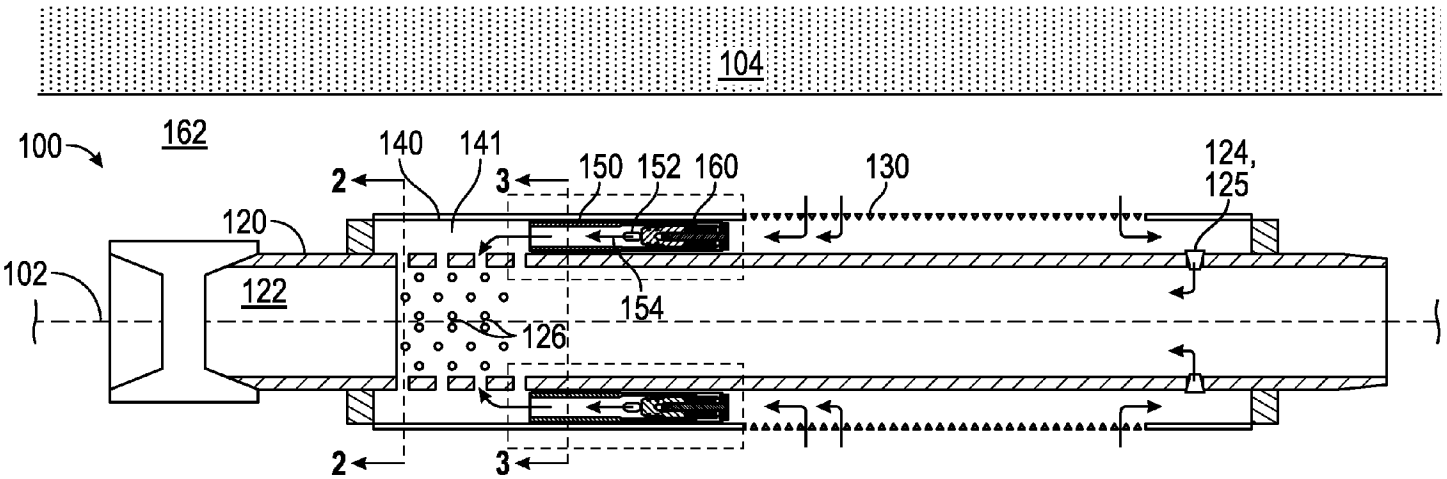
FIG. 1A depicts a partial cross-sectional view of an illustrative downhole tool, according to one or more embodiments disclosed.

FIG. 1A depicts a partial cross-sectional view of an illustrative downhole tool 100, according to one or more embodiments disclosed. As shown, the downhole tool 100 may be or include a completion assembly. However, in other embodiments, instead of or in addition to the completion assembly, the downhole tool 100 may be or include a packer, such as an open hole swellable packer or a shunted zonal isolation packer.

The downhole tool 100 may include an outer tubular member (referred to herein as a "housing") 140 and a screen 130. An inner tubular member 120 may be positioned radially-inward from the housing 140 such that an annulus 141 is formed therebetween, and a first opening 126 may be formed radially-through the inner tubular member 120. A valve 160 may be positioned within the annulus 141. A flow control device (e.g., 410, 1219) may be positioned within the annulus 141. A degradable member (e.g., 440, 1240) may be configured to at least partially degrade in response to contact with a fluid, and the valve 160 is configured to actuate from a first position to a second position in response to the degradable member (e.g., 440, 1240) at least partially degrading, thereby changing a proportion of the fluid that flows through the screen 130 that flows through the flow control device (e.g. 125, 125B-D, 1219). Said another way, the proportion of the fluid that flows through the flow control device (e.g. 125, 125B-D, 1219) after entering the screen 130 may change (e.g., increase).

For example, with reference to FIG. 1A, when the valves 160 are in the first position (e.g., during the gravel packing phase), a portion of the fluid entering the screen 130 (e.g., greater than 50%) may flow through valves 160 to the gravel pack return openings 126, and a portion of the fluid entering the screen 130 (e.g., less than 50%) may flow through flow control devices 125. While the fluid may flow through both the openings 126 and the flow control devices 125 when the valve is in the first position, the flow restriction provided by the flow control device 125 may cause the majority of the fluid to flow through the openings 126. However, when the valves 160 are in the second position (e.g., during the production phase), a majority of the fluid (e.g., 100%) of the fluid that enters the screen 130 may flow through the flow control device 125.

The downhole tool 100 may include an inner tubular member 120 having an axial bore 122 formed therethrough. As used herein, a "tubular member" may have any cross-sectional shape including circular and non-circular. The inner tubular member 120 may be referred to as a base pipe. The housing 140 may be disposed at least partially around the base pipe 120 such that an annulus (a "housing annulus") 141 may be formed between the base pipe 120 and the housing 140. The housing 140 may be or include a single tubular, multiple sections of tubular, or sections of tubular combined with other housing segments and screens. The downhole tool 100 may also include one or more screens 130 positioned radially-outward from the base pipe 120. The screen 130 may be or include a wire wrapped helically around the base pipe 120, a mesh, a slotted liner, or the like configured to filter wellbore solids. In at least one embodiment, the screen 130 may be coupled to or integral with the housing 140.

One or more first or "production" openings (two are shown: 124) may be formed radially-through the base pipe 120. The production openings 124 may be axially-offset from the screen 130. As shown, the production openings 124 may be positioned "below" the corresponding screen 130. When more than one production opening 124 is utilized in the downhole tool 100, the production openings 124 may be axially and/or circumferentially offset from one another.

The production opening 124 may have a flow control device 125 disposed therein (e.g., threaded into the opening 124). The flow control device 125 may have an inner diameter from about 1.5 mm to about 4 mm. The flow control device 125 may be an inflow control device ("ICD") or an injection flow control device. An injection flow control device refers to an ICD that is configured to control flow out of the base pipe 120 rather than into the base pipe 120. ICDs may include both passive ICDs and autonomous ICDs ("AICDs"). Passive ICDs refer to ICDs that restrict fluid flow without being selective of fluids with certain composition or physical characteristics. Examples of such passive ICDs include nozzles, tortuous paths, and friction tubes. Autonomous ICDs refer to ICDs that change their flow restriction characteristics based on the fluid's composition or physical characteristics. For example, an AICD may have increased flow restriction when the water or gas content of the production fluid increases. Examples of AICDs include AICDs that use the Bernoulli principle, such as Tendeka's FloSure™ AICD, or other type of AICDs, such as Halliburton's EquiFlow® AICD.

Figure 1B:
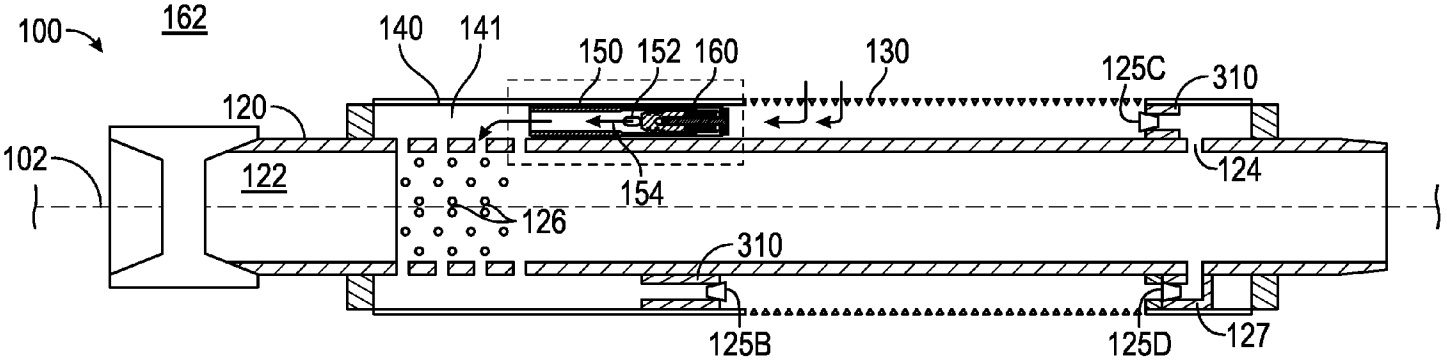
FIG. 1B depicts a partial cross-sectional view of the downhole tool shown in FIG. 1A including different flow control devices, according to one or more embodiments disclosed.

In FIG. 1A, the flow control device 125 is depicted as partially within the opening 124. However, the flow control device 125 may be located anywhere within the flow path from the screen 130 to the base pipe 120. For example, as shown in FIG. 1B, an axial obstruction 310 may be positioned in the housing annulus 131 between the screen 130 and the openings 126. A flow control device 125B may be positioned within a bore that extends axially-through the obstruction 310. In another embodiment, the obstruction 310 may be positioned in the housing annulus 131 between the screen 130 and the production openings 124. A flow control device 125C may be positioned within a bore that extends axially-through the obstruction 310. In yet another embodiment, a flow control device 125D may be positioned within a conduit 127 that is coupled to and/or in fluid communication with the production openings 124 or the gravel pack return opening 126. Also, the conduit 127 may be coupled to the outlet of intermediate tubular member 150 of the valve 1200 similar to FIG. 12 including a flow control device 1219. The obstruction 310 may not extend completely across the radial width of the annulus 131 or may be omitted in embodiments using the conduit 127.

In at least one embodiment, the portion of the housing 140 between the obstruction 310 and the screen 130 may have filtered communication with the wellbore annulus 162. For example, this portion of the housing 140 may have openings formed therethrough that are covered with a mesh filter to retain sand control. This may be useful during dehydration during gravel packing operations.

One or more second or "gravel pack return" openings 126 may also be formed radially-through the base pipe 120. The gravel pack return openings 126 may be axially-offset from the screen 130 and axially-aligned with the housing 140. As shown, the gravel pack return openings 126 may be positioned "above" the screen 130. Thus, the screen 130 may be positioned axially-between the production opening 124 and the gravel pack return openings 126. When more than one gravel pack return opening 126 is utilized in the downhole tool 100, the gravel pack return openings 126 may be axially and/or circumferentially offset from one another.

Each gravel pack return opening 126 may have a diameter of from about 5 mm to about 75 mm, about 6 mm to about 30 mm, or about 8 mm to about 15 mm. The gravel pack return openings 126 may have an aggregate cross-sectional areal that is at least 5 times, at least 10 times, at least 20 times, at least 50 times, or at least 100 times greater than an aggregate cross-sectional area of the production opening(s) 124. This may allow greater amounts of fluid to flow through the gravel pack return openings 126 than through the production opening(s) 124.

One or more valves 160 may be disposed in the housing annulus 141. In FIG. 1A, the valve 160 is shown as a plunger-type valve. However, the valve 160 may be or include a check valve, a ball valve, a sliding sleeve, a hinged-flapper, or any other type of valve that may be actuated by a spring or other biasing member.

The valve 160 may include an intermediate tubular member 150 disposed in the housing annulus 141 and positioned axially-between the screen 130 and the gravel pack return openings 126. The intermediate tubular members 150 may be substantially parallel to a longitudinal axis through the base pipe 120 and/or the housing 140. The intermediate tubular member 150 may have one or more openings 152 formed radially-therethrough.

The valve 160 in FIG. 1A is shown in a first position where the opening 152 in the intermediate tubular member 150 is unobstructed. When the valve 160 is in the first position, fluid may flow along the flowpath shown by the arrows 154. More particularly, the fluid may flow into the housing annulus 141 through the screen 130. The fluid may then flow radially-inward into the intermediate tubular member 150 through the opening 152. The fluid may then flow out the end of the intermediate tubular member 150 and into the bore 122 of the base pipe 120 though the gravel pack return openings 126 in the base pipe 120.

In at least one embodiment, the intermediate tubular member 150 may be coupled (e.g., threadably coupled) to a single gravel pack return opening 126. In another embodiment, the intermediate tubular member 150 may be coupled to a conduit extending to the gravel pack return opening 126. Furthermore, if two valves 160 are adjacent, collinear, and/or opposing one another, these two valves 160 may be threadably coupled to the single gravel pack return opening 126. The single gravel pack return opening 126 may have a diameter of from about 25 mm to about 75 mm. In these embodiments, the obstruction 310 may not be present or may not extend completely across the housing annulus 141; rather, the obstruction may be accomplished by the threads when the intermediate tubular members 150 are coupled to the gravel pack return opening 126.

Figure 2:
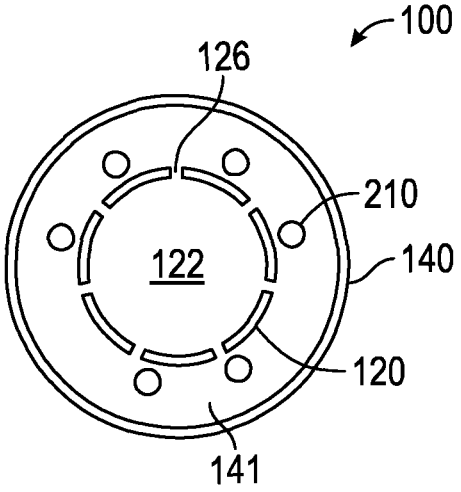
FIG. 2 depicts a cross-sectional view of the downhole tool taken along line 2-2 in FIG. 1A, according to one or more embodiments disclosed.

FIG. 2 depicts a cross-sectional view of the downhole tool 100 taken along line 2-2 in FIG. 1A, according to one or more embodiments disclosed. One or more shunt tubes 210 may be disposed in the housing annulus 141 between the base pipe 120 and the housing 140. As shown, six shunt tubes 210 are shown circumferentially-offset from one another. As discussed in greater detail below, the shunt tubes 210 may provide an alternate path for the gravel slurry to flow when the wellbore annulus 162 is obstructed (e.g., with gravel particles). For example, the gravel slurry may flow from the wellbore annulus 162 into the shunt tubes 210 when the wellbore annulus 162 is obstructed with gravel particles, and the gravel slurry may flow back out into the wellbore annulus 162 after the obstruction has been bypassed. Using shunt tubes 210 for delivering the gravel slurry to the wellbore is often referred to as alternate path gravel packing. In another embodiment, the shunt tubes 210 may be positioned in the wellbore annulus 162 (e.g., radially-outward from the screen 130 and housing 140).

Figure 3:
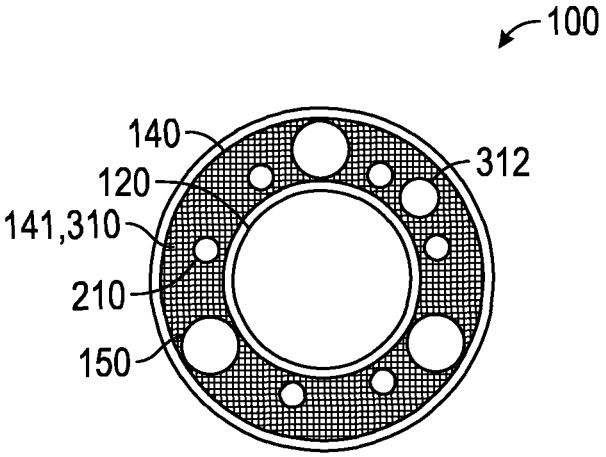
FIG. 3 depicts a cross-sectional view of the downhole tool taken along line 3-3 in FIG. 1A, according to one or more embodiments disclosed.

FIG. 3 depicts a cross-sectional view of the downhole tool 100 taken along line 3-3 in FIG. 1A, according to one or more embodiments disclosed. FIG. 3 shows the intermediate tubular members 150 and the shunt tubes 210 disposed within the housing annulus 141. The intermediate tubular members 150 may be circumferentially-offset from one another and/or the shunt tubes 210. Although three intermediate tubular members 150 are shown, it will be appreciated that more or fewer intermediate tubular members 150 may be utilized.

An axial barrier or obstruction 310 may also be disposed in the housing annulus 141 but outside the intermediate tubular members 150 and the shunt tubes 210. The axial obstruction 310 may be made of a metal, a polymer, an elastomer (e.g., a swellable elastomer), or a combination thereof. In one example, the axial obstruction 310 may be a packer assembly. The axial obstruction 310 may prevent fluid from flowing axially-through the housing annulus 141, except for the fluid flowing through the intermediate tubular members 150 and/or the shunt tubes 210. In at least one embodiment, one or more ICDs (one is shown: 312) may be embedded in the axial obstruction 310 and provide yet another path for fluid to flow therethrough.

Figure 4:
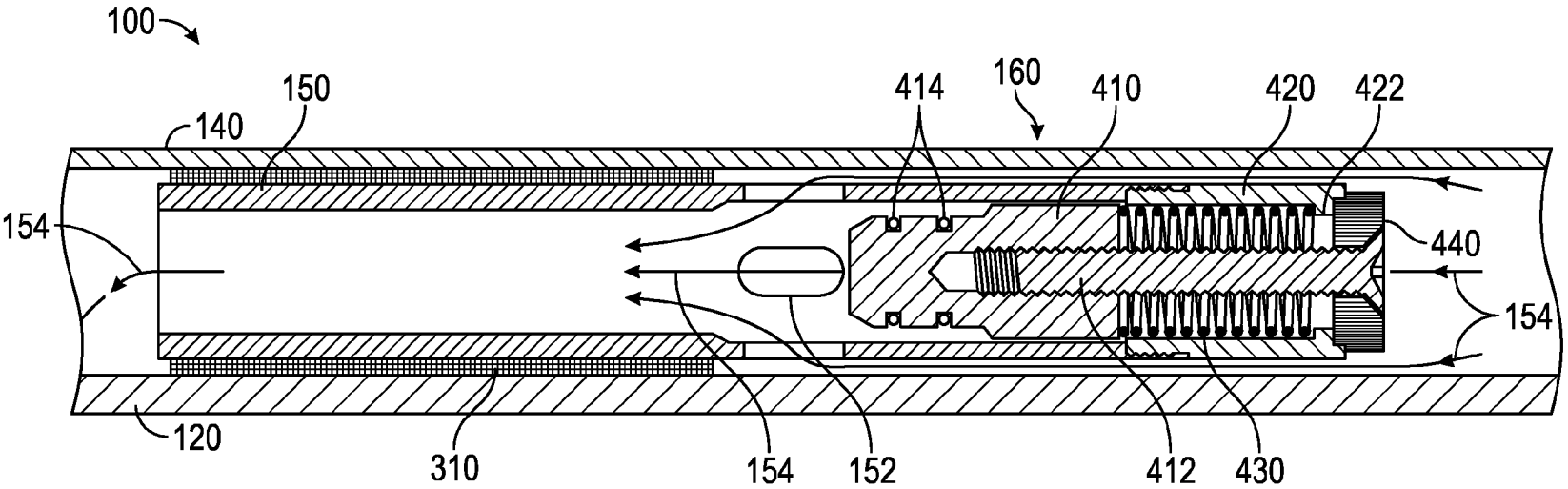
FIG. 4 depicts a cross-sectional view of a portion of the downhole tool with an illustrative valve in a first position that allows flow through a tubular member, according to one or more embodiments disclosed.

FIG. 4 depicts a cross-sectional view of a portion of the downhole tool 100 with the valve 160 in a first position that allows flow through the intermediate tubular member 150, according to one or more embodiments disclosed. The valve 160 may include a body 410 positioned at least partially within the intermediate tubular member 150. A first end of a bolt or shaft 412 may be coupled to and at least partially disposed within the body 410. As shown, the shaft 412 may be coupled (e.g., threaded) to the body 410. The body 410 may have one or more sealing members (two are shown: 414) disposed at least partially thereabout. The sealing members 414 may be axially-offset from one another. The sealing members 414 may be or include elastomeric O-rings or a metal-to-metal seal.

An annular insert 420 may be disposed at least partially around the shaft 412 and/or the body 410. The insert 420 may be coupled (e.g., threaded) to the intermediate tubular member 150 or otherwise secured axially in place with respect to the intermediate tubular member 150. A biasing member (e.g., a spring) 430 may be disposed radially-between the shaft 412 and the insert 420 and/or between the shaft 412 and the inner surface of the intermediate tubular member 150. When the valve 160 is in the first position, as shown in FIG. 4, the biasing member 430 may be compressed axially-between the body 410 and an inner shoulder 422 of the insert 420. Although shown as a spring in FIG. 4, in other embodiments, the biasing member 430 may be a compressed fluid or the like.

A second end of the shaft 412 may be coupled to a degradable member 440. For example, an upset on the shaft 412 may be retained by the degradable member 440. The degradable member 440 may be made of one or more materials that are configured to degrade or dissolve in response to contact with a fluid. More particularly, the degradable member 440 may degrade or dissolve sufficiently to release the shaft 412 therefrom in a predetermined amount of time in response to contact with the fluid. The degradable member 440 may be made from metals (e.g., calcium, magnesium, aluminum, and their alloys), polymeric materials, or plastic materials. Polymeric materials may be or include water-soluble or oil-soluble polymers or combinations thereof. Examples of water-soluble polymers include (a) polyesters such as polylactic acid (PLA), polyglycolic acid (PGA), poly(caprolactone), (b) polyanhydrides, (c) polycarbonates, (d) polyurethanes, (e) polysaccharides, (f) polyethers such as poly(ethylene oxide), and combinations or copolymers thereof. Examples of oil-soluble polymers include (a) polyolefins such as polyisobutylenes, (b) polyethers such as polybutylene oxides and combinations or copolymers thereof. In addition, composites of degradable polymeric with other degradable or non-degradable materials may be employed to enhance the mechanical properties of the polymeric degradable member. Examples of non-polymeric additives include metals, carbon fibers, clays, non-degradable polymers, etc. The degradable material may be a composite of several materials, or include layers or coatings of different materials. The fluid that causes the degradable member 440 to degrade or dissolve may be or include water, formation fluid (e.g., hydrocarbons), a polar solvent, a non-polar solvent, gravel pack carrier fluid, an additive that is pumped downhole, or a combination thereof. The degradable material may include various combinations of aluminum, magnesium, gallium, indium, bismuth, silicon and zinc. In one particular example, the degradable material may be an aluminum alloy including about 0.5 wt % to about 8.0 wt % Ga, about 0.5 wt % to about 8.0 wt % Mg, less than about 2.5 wt % In, and less than about 4.5 wt % Zn. In some embodiments, the degradable material may include an outer coating that is degradable in contact with one fluid or additive and an inner layer that is degradable in contact with another fluid or additive. In some embodiments, degradation may be achieved by spotting a fluid with which at least a portion of the degradable material interacts with to promote degradation.

In at least one embodiment, the member 440 may swell rather than degrade. Illustrative swellable materials may include ethylene-propylene-copolymer rubber, ethylene-propylene-diene terpolymer rubber, butyl rubber, halogenated butyl rubber, brominated butyl rubber, chlorinated butyl rubber, chlorinated polyethylene, starch-polyacrylate acid graft copolymer, polyvinyl alcohol cyclic acid anhydride graft copolymer, isobutylene maleic anhydride, acrylic acid type polymers, vinylacetate-acrylate copolymer, polyethylene oxide polymers, carboxymethyl cellulose type polymers, starch-polyacrylonitrile graft copolymers, highly swelling clay minerals (i.e. sodium bentonite), styrene butadiene hydrocarbon, ethylene propylene monomer rubber, natural rubber, ethylene propylene diene monomer rubber, ethylene vinyl acetate rubber, hydrogenised acrylonitrile-butadiene rubber, acrylonitrile butadiene rubber, isoprene rubber, chloroprene rubber, or polynorbornene. While the specific chemistry is of no limitation to the present disclosure, swellable compositions commonly used in downhole environments include swellable elastomers.

The predetermined amount of time may be less than about 24 hours, less than 3 days, less than 1 week, less than 2 weeks, less than one month, or more than one month. The rate that the degradable member 440 degrades or dissolves may depend, at least partially, upon the type or composition of degradable material, the type of fluid, the time in contact with the fluid, the temperature of the fluid, the pressure of the fluid, the pH of the fluid, or a combination thereof. The degradable member 440 may degrade or dissolve before production takes place (e.g., before hydrocarbons flow through the screen 130).

As shown, the axial obstruction 310 may be positioned axially-between the opening 152 in the intermediate tubular member 150 and the gravel pack return openings 126 in the base pipe 120 (see FIGS. 1 and 4). In at least one embodiment, the axial obstruction 310 may not be positioned axially-between the opening 152 in the intermediate tubular member 150 and the screen 130. The axial obstruction 310 may, however, form first and second annulus sections on either side thereof. The valve 160 may be positioned in the first annulus section for production operations and/or in the second annulus section for injection operations. During injection operations, water or steam injection fluids may flow from the base pipe 120 to the second annulus section through the intermediate tubular member 150, the valve 160, and out through the screen 130.

Referring now to FIGS. 1A and 4, prior to the degradable member 440 degrading (e.g., reacting, corroding, or dissolving) or swelling, the degradable member 440 may be in contact with the shoulder 422 of the insert 420, which may secure the valve 160 in the first position. When the valve 160 is in the first position, fluid may flow from the screen 130, through the housing annulus 141, to the opening 152 in the intermediate tubular member 150, as shown by arrows 154. The fluid may be prevented from flowing further through the housing annulus 141 in an axial direction by the axial obstruction 310. However, the fluid may flow radially-inward into the intermediate tubular member 150 through the opening 152. The fluid may then flow out of an axial end of the intermediate tubular member 150 and into the bore 122 of the base pipe 120 via the gravel pack return openings 126 in the base pipe 120.

Figure 5:
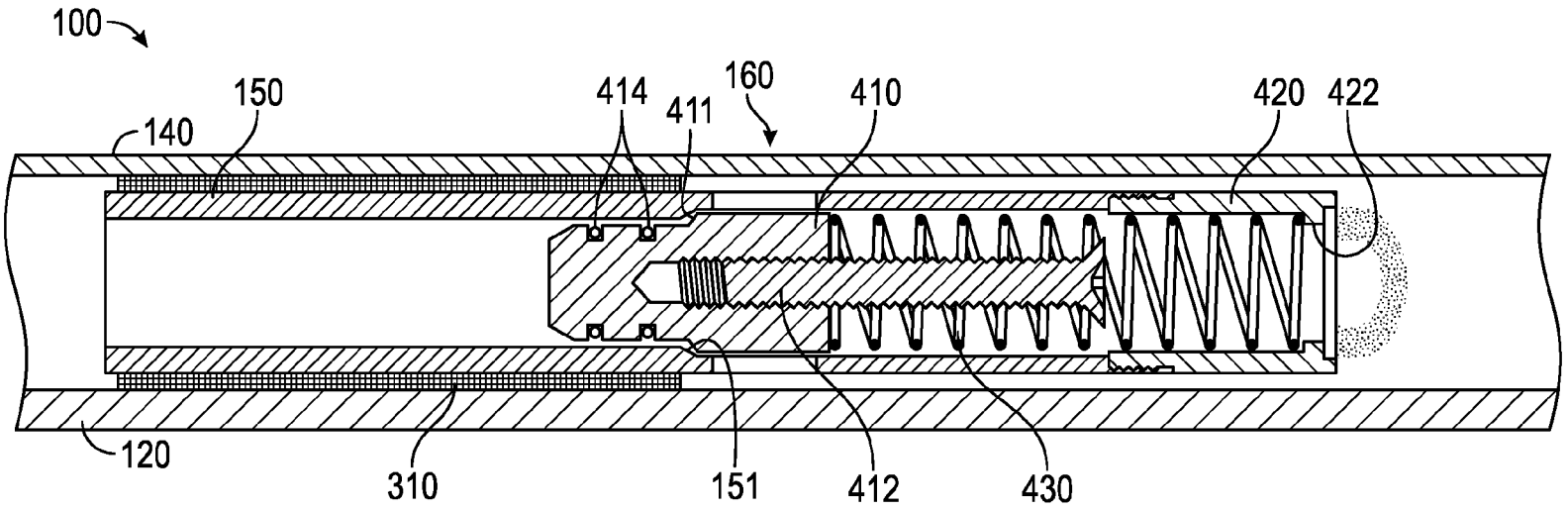
FIG. 5 depicts a cross-sectional view of the portion of the downhole tool shown in FIG. 4 with the valve in a second position that prevents flow through the tubular member after a degradable member has degraded, according to one or more embodiments disclosed.

FIG. 5 depicts a cross-sectional view of the portion of the downhole tool 100 shown in FIG. 4 with the valve 160 in a second position that prevents fluid flow through the intermediate tubular member 150 after the degradable member 440 has degraded, according to one or more embodiments disclosed. Once the degradable member 440 contacts the fluid, the degradable member 440 may at least partially degrade or dissolve in the predetermined amount of time sufficiently to release the shaft 412. In another embodiment, instead of or in addition to the degradable member 440, an expandable (e.g., swellable) member may be configured to expand (e.g., swell) in response to contact with the fluid, and the shaft 412 may release in response to the expansion.

When the shaft 412 is released, the biasing member (e.g., spring) 430 may expand, thereby moving the shaft 412 and the body 410 axially within the intermediate tubular member 150 to the second position where the body 410 changes the proportion of the fluid that flows through the screen 130 that also flows through opening 152. And, in the embodiment shown in FIG. 1A, this may reduce the proportion of screened fluid flowing through the gravel pack return openings 126. As shown, the body 410 prevents (e.g., stops 90% or more of the) fluid from flowing into and through the intermediate tubular member 150. The sealing members 414 around the body 410 may form the seal between the body 410 and the intermediate tubular member 150 when the body 410 is in the second position. A shoulder 411 on the outer surface of the body 410 may contact a seat 151 on an inner surface of the intermediate tubular member 150 to halt the valve 160 in the second position.

When the valve 160 is in the second position, the fluid may no longer flow into the intermediate tubular member 150 through the opening 152. This may obstruct the flowpath 154 (see FIGS. 1 and 4) from the screen 130 to the gravel pack return openings 126 in the base pipe 120. As a result, the fluid entering the screen 130 may flow into the bore 122 of the base pipe 120 through the production opening 124 and the flow control device 125. In another embodiment, the production opening 124 and the flow control device 125 in the base pipe 120 may be omitted, and the production flow may go through the flow control device 312 in the axial obstruction 310 (see FIG. 3) when the valve 160 moves to the second position.

Figure 6:
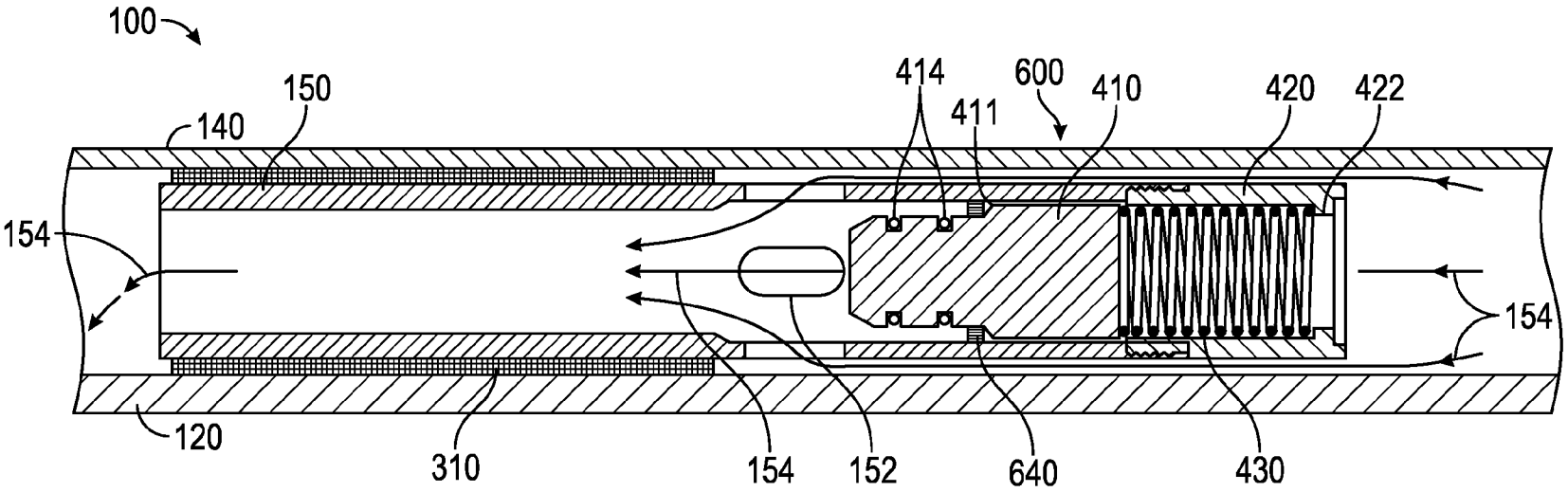
FIG. 6 depicts a cross-sectional view of a portion of the downhole tool with another illustrative valve in a first position that allows flow through the tubular member, according to one or more embodiments disclosed.

FIG. 6 depicts a cross-sectional view of a portion of the downhole tool 100 with another illustrative valve 600 in a first position that allows flow through the tubular member 150, according to one or more embodiments disclosed. The valve 600 in FIG. 6 may be similar to the valve 160 in FIGS. 4 and 5. The shaft 412 may be optional in the valve 600. As shown, the shaft 412 has been omitted.

The valve 600 (e.g., the body 410) may be held in place by a degradable member 640. The degradable member 640 may be positioned radially-between the body 410 and the intermediate tubular member 150 anywhere along the length of the body 410. As shown, the degradable member 640 may be annular and positioned at least partially within a recess formed in the inner surface of the intermediate tubular member 150. When the valve 600 is in the first position, the degradable member 640 may be positioned against the shoulder 411 (or another shoulder or upset) on the outer surface of the body 410. In another embodiment, the degradable member 640 may be positioned at least partially within a recess formed in the outer surface of the body 410. In yet another embodiment, the degradable member 640 may be positioned adjacent to a leading axial end of the body 410.

The degradable member 640 may prevent the body 410 from moving into the second position (e.g., to the left, as shown in FIG. 6).

Figure 7:
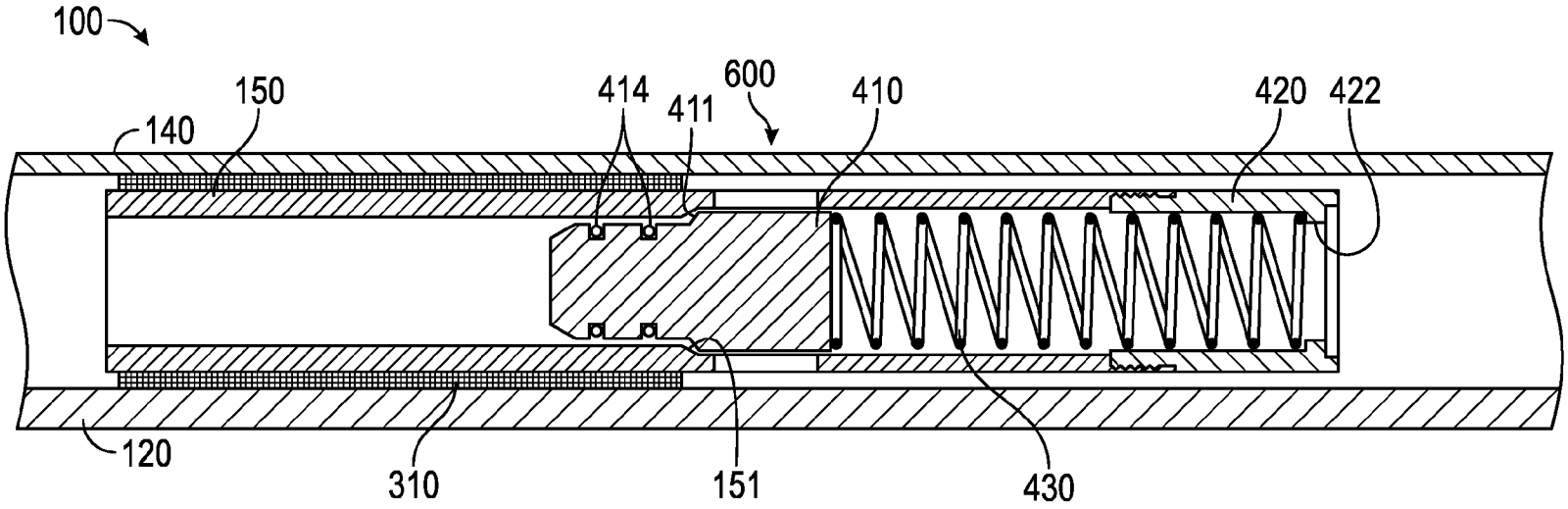
FIG. 7 depicts a cross-sectional view of the portion of the downhole tool shown in FIG. 6 with the valve in a second position that prevents flow through the tubular member after a degradable member has degraded, according to one or more embodiments disclosed.

FIG. 7 depicts a cross-sectional view of the portion of the downhole tool 100 shown in FIG. 6 with the valve 600 in a second position that prevents fluid flow through the intermediate tubular member 150 after the degradable member 640 has degraded, according to one or more embodiments disclosed. Once the degradable member 640 contacts the fluid, the degradable member 640 may at least partially degrade or dissolve in the predetermined amount of time sufficiently to allow the biasing member 430 to expand, thereby moving the body 410 axially within the intermediate tubular member 150 to the second position where the body 410 prevents fluid from flowing through the intermediate tubular member 150, as described above with respect to FIG. 5.

Figure 8:
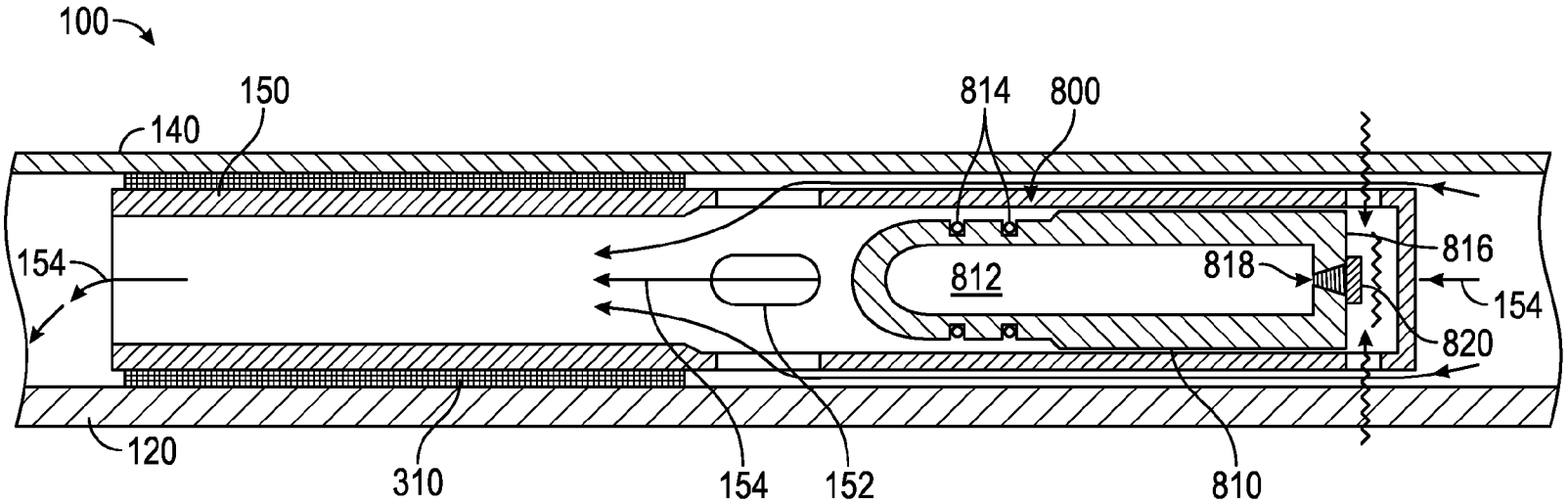
FIG. 8 depicts a cross-sectional view of a portion of the downhole tool with another illustrative valve in a first position that allows flow through the tubular member, according to one or more embodiments disclosed.

FIG. 8 depicts a cross-sectional view of a portion of the downhole tool 100 with another illustrative valve 800 in a first position that allows flow through the tubular member 150, according to one or more embodiments disclosed. The valve 800 may include a body 810 having one or more seals 814 disposed thereabout. The body 810 may define an interior volume 812. The interior volume 812 may have a biasing member such as a compressed fluid disposed therein. Without limitation, the fluid may be or include air, water, hydrocarbon gas, an inert gas such as nitrogen or carbon dioxide, or a combination thereof. The fluid may have a pressure from about 500 kPa to about 5 MPa, about 5 MPa to about 20 MPa, or about 20 MPa to about 50 MPa.

An axial end 816 of the body 810 may have an opening 818 formed axially therethrough. A plug 820 may be disposed at least partially in the opening 818 to prevent the compressed fluid from escaping. The plug 820 may be made from one or more materials that degrade, dissolve, or swell in response to contact with a fluid. More particularly, the plug 820 may degrade, dissolve, or swell sufficiently to release the compressed fluid a predetermined amount of time after the contact with the fluid. The degradable material may be the same as that discussed above with reference to FIGS. 4 and 5.

Figure 9:
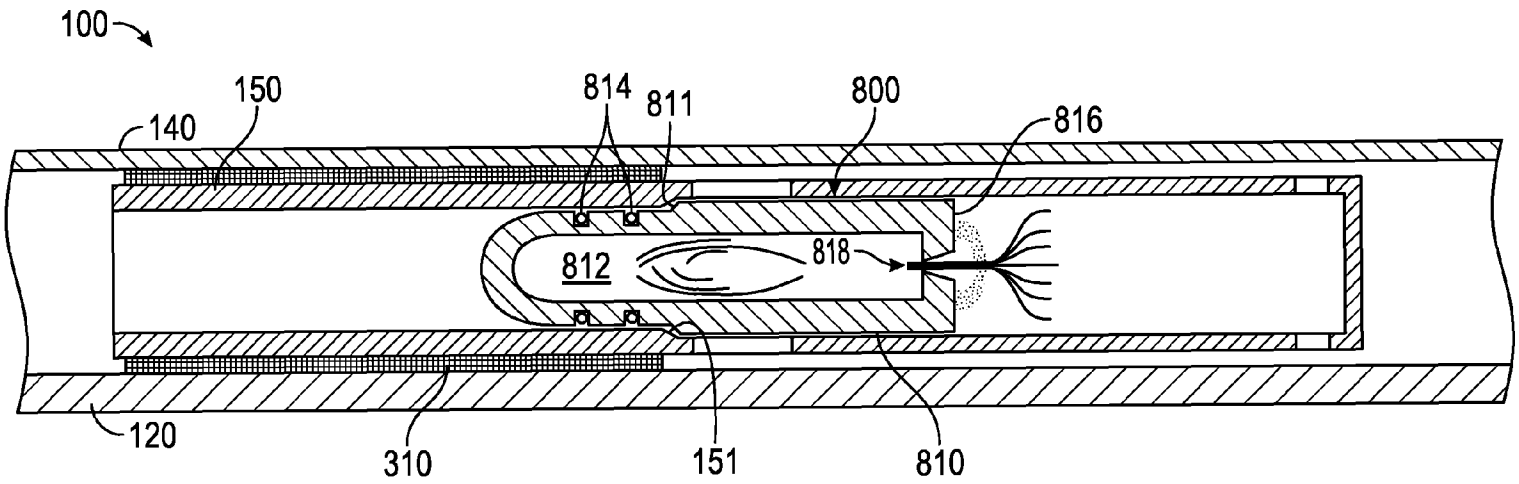
FIG. 9 depicts a cross-sectional view of the portion of the downhole tool shown in FIG. 8 with the valve in a second position that prevents flow through the tubular member after a plug has degraded, according to one or more embodiments disclosed.

FIG. 9 depicts a cross-sectional view of the portion of the downhole tool 100 shown in FIG. 6 with the valve 800 in a second position that prevents fluid from flowing through the intermediate tubular member 150 after the plug 820 has degraded, according to one or more embodiments disclosed. Once the plug 820 contacts the fluid, the plug 820 may degrade, dissolve, or swell in the predetermined amount of time. When the plug 820 degrades or dissolves, the compressed fluid may escape through the opening 818 in the body 810, thereby propelling the body 810 axially within the intermediate tubular member 150 to the second position where the body 810 prevents fluid from flowing through the intermediate tubular member 150, as described above with respect to FIG. 5.

Figure 10:
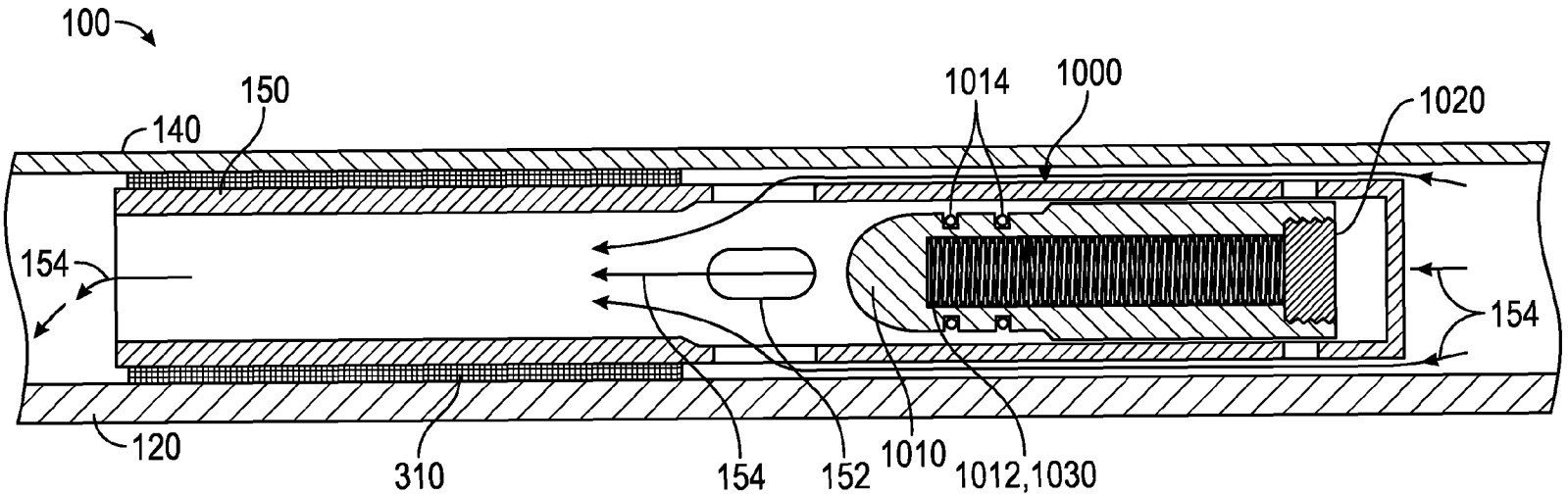
FIG. 10 depicts a cross-sectional view of a portion of the downhole tool with yet another illustrative valve in a first position that allows flow through the tubular member, according to one or more embodiments disclosed.

FIG. 10 depicts a cross-sectional view of a portion of the downhole tool 100 with yet another illustrative valve 1000 in a first position that allows flow through the tubular member 150, according to one or more embodiments disclosed. The valve 1000 may include a body 1010 having one or more seals 1014 disposed thereabout. The body 1010 may define an interior volume 1012. A biasing member such as a spring 1030 may be disposed within the interior volume 1012. A cap 1020 may be coupled (e.g., threaded) to an axial end of the body 1010, and the spring 1030 may be compressed between the body 1010 and the cap 1020.

The cap 1020 may be made from one or more materials that degrade, dissolve, or swell in response to contact with a fluid. More particularly, the cap 1020 may degrade, dissolve, or swell sufficiently in a predetermined amount of time after the contact with the fluid to allow the spring 1030 to expand. The degradable material may be the same as that discussed above with reference to FIGS. 4 and 5.

Figure 11:
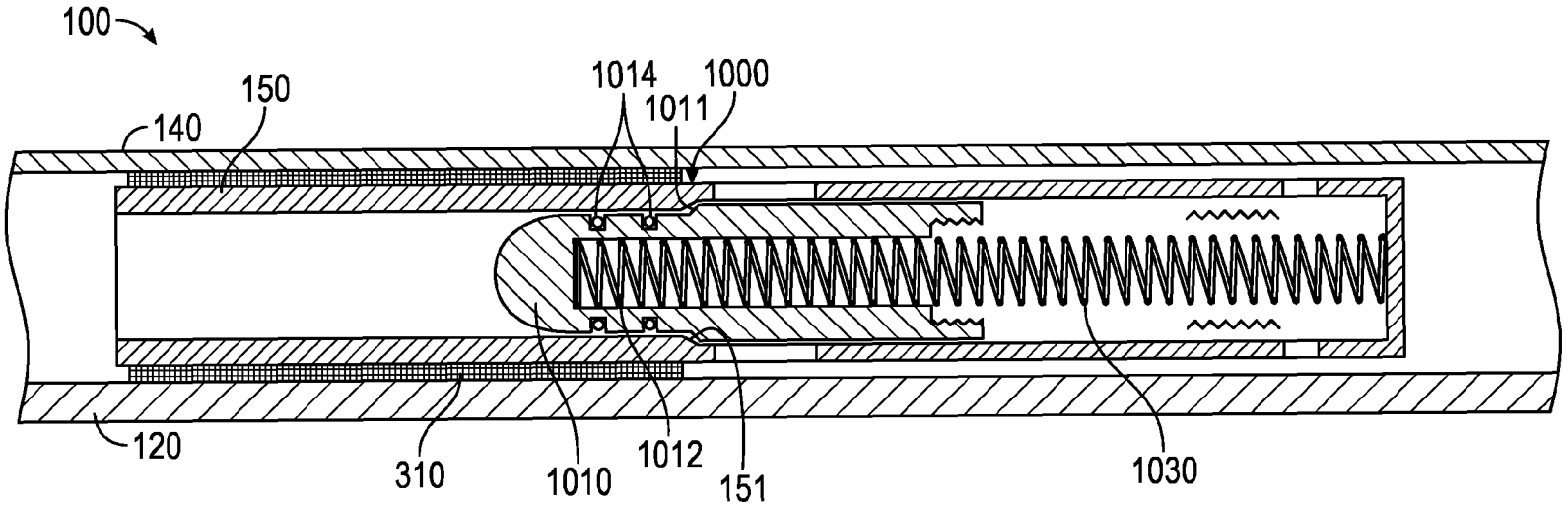
FIG. 11 depicts a cross-sectional view of the portion of the downhole tool shown in FIG. 10 with the valve in a second position that prevents flow through the tubular member after a cap has degraded, according to one or more embodiments disclosed.

FIG. 11 depicts a cross-sectional view of the portion of the downhole tool 100 shown in FIG. 10 with the valve 1000 in a second position that prevents fluid from flowing through the intermediate tubular member 150 after the cap 1020 has degraded, according to one or more embodiments disclosed. Once the cap 1020 contacts the fluid, the cap 1020 may at least partially degrade, dissolve, or swell in the predetermined amount of time. When the cap 1020 at least partially degrades, dissolves, or swells, the compressed spring 1030 may expand, thereby propelling the body 1010 axially within the intermediate tubular member 150 to the second position where the body 1010 prevents fluid from flowing through the intermediate tubular member 150, as described above with respect to FIG. 5.

Figure 12:
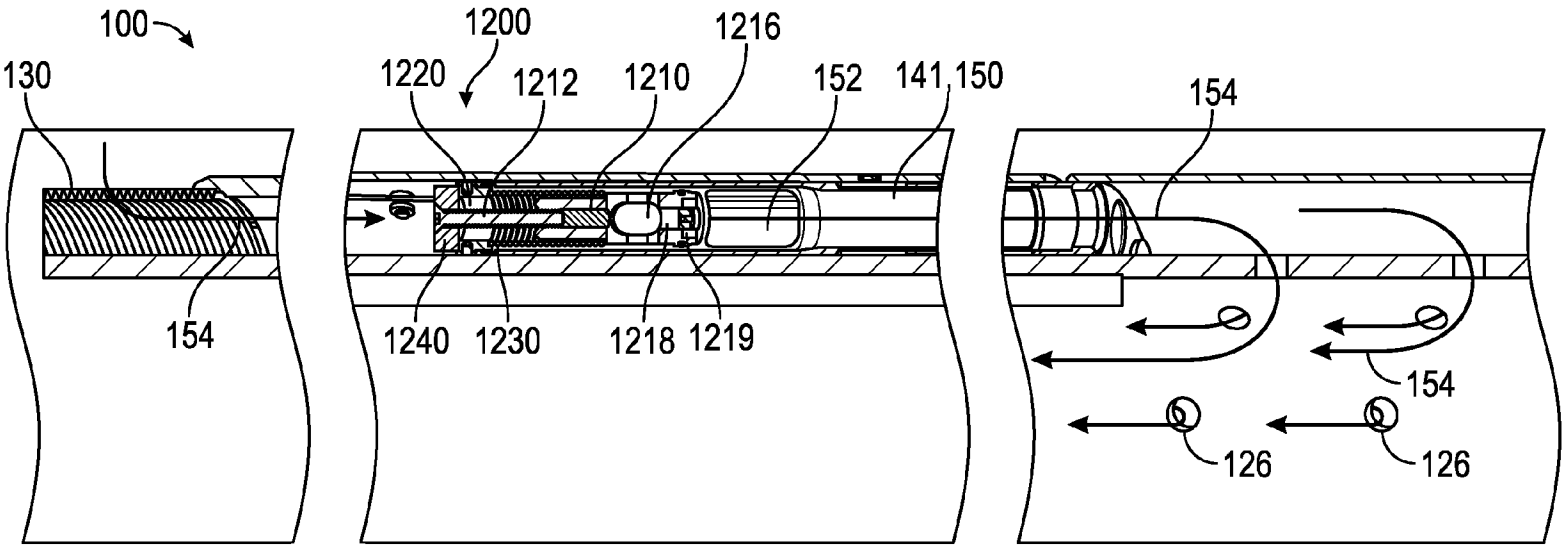
FIG. 12 depicts a cross-sectional view of a portion of the downhole tool with yet another illustrative valve in a first position that allows flow through the tubular member, according to one or more embodiments disclosed.

FIG. 12 depicts a partial cross-sectional view of the downhole tool 100 shown in FIG. 1A having a different valve 1200 in a first position where the valve 1200 is offset from the opening 152 in the intermediate tubular member 150, according to one or more embodiments disclosed. The valve 1200 may be similar to the valve 160 in FIGS. 4 and 5 in that it may include the intermediate tubular member 150, a body 1210, a shaft 1212, an insert 1220, a biasing member (e.g., a spring) 1230, a degradable member 1240, or a combination thereof. The body 1220 may include one or more openings 1216 formed radially-therethrough. The openings 1216 may be axially and/or circumferentially-offset from one another.

Prior to the degradable member 1240 degrading or dissolving, the degradable member 1240 may be in contact with the insert 1220, which may secure the valve 1200 in a first position where the valve 1200 is axially-offset from the opening 152 in the intermediate tubular member 150. When the valve 1200 is in the first position, fluid may flow along the same flow path 154 as described above with respect to FIG. 4. More particularly, the fluid may flow into the housing annulus 141 through the screen 130. The fluid may then flow radially-inward through the opening 152 into the intermediate tubular member 150. The fluid may then flow out of an axial end of the intermediate tubular member 150 and into the bore 122 of the base pipe 120 though the gravel pack return openings 126 in the base pipe 120.

Figure 13:
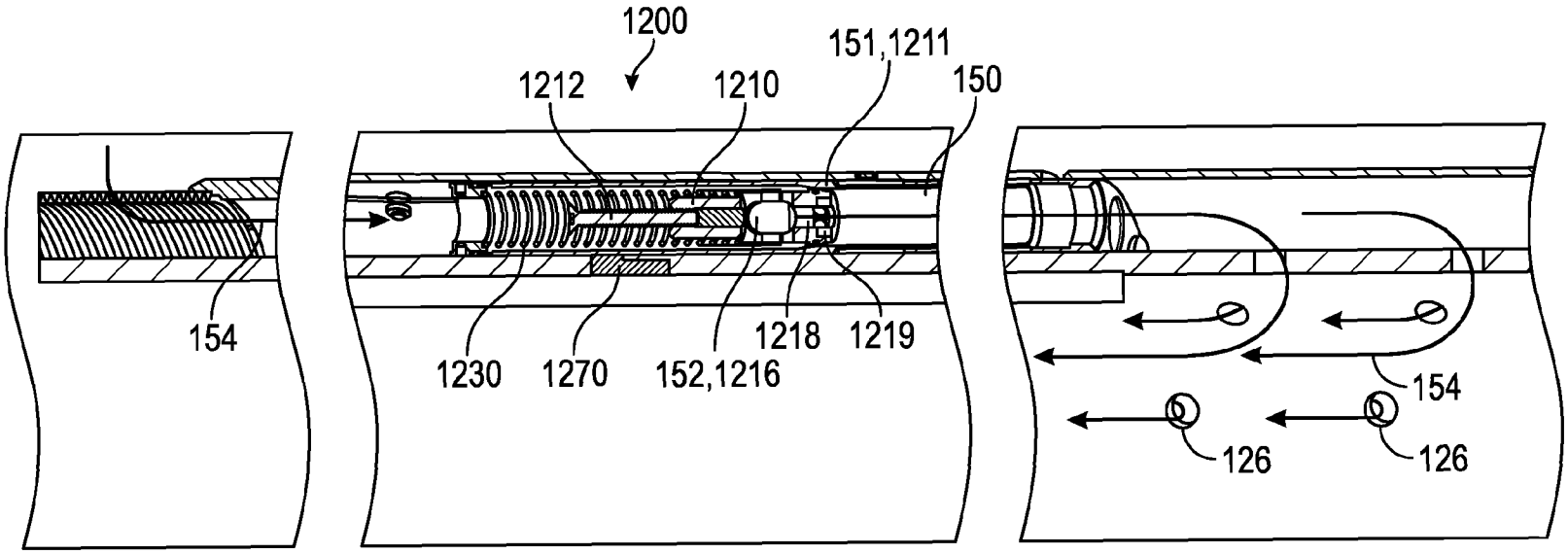
FIG. 13 depicts a cross-sectional view of the portion of the downhole tool shown in FIG. 12 with the valve in a second position that restricts fluid flow through tubular member after a degradable material has degraded, according to one or more embodiments disclosed.

FIG. 13 depicts a cross-sectional view of the portion of the downhole tool 100 shown in FIG. 12 with the valve 1200 in a second position where the openings 1216 in the valve 1200 are aligned with the openings 152 in the intermediate tubular member 150, according to one or more embodiments disclosed. Once the degradable member 1240 contacts the fluid, the degradable member 1240 may at least partially degrade, dissolve, or swell in the predetermined amount of time sufficiently to release the shaft 1212. When the shaft 1212 is released from the degradable member 1240, the biasing member (e.g., spring) 1230 may expand, thereby moving the shaft 1212 and the body 1210 axially within the intermediate tubular member 150 to the second position. In other embodiments, the biasing member may include a compressed fluid that moves the body 1210 to the second position, as described above.

When the valve 1200 is in the second position, the openings 1216 in the body 1210 of the valve 1200 may be at least partially aligned with or overlap the openings 152 in the intermediate tubular member 150. In at least one embodiment, the openings 1216 in the body 1210 of the valve 1200 may have a smaller cross-sectional area than the openings 152 in the intermediate tubular member 150. In yet another embodiment, the body 1210 may have one or more nozzles disposed therein (e.g., threaded into the openings 1216).

When the valve 1200 is in the second position and the openings 152, 1216 are at least partially aligned or overlapping, fluid may flow radially-inward through the openings 152, 1216 into an axial bore 1218 that extends at least partially through the body 1210. In at least one embodiment, the axial bore 1218 may have the flow control device (e.g., a nozzle) 1219 positioned therein. The axial bore 1218 and/or the flow control device 1219 may have a diameter of from about 1.5 mm to about 4 mm. Further, when the valve 1200 is in the second position, the proportion of the fluid that enters the housing annulus 141 through the screen 130 that then flows through the flow control device 1219 may change (e.g., increase). For example, when the valves 1200 are in the first position (e.g., during a gravel packing operation), 0% of the fluid that enters the housing annulus 141 through the screen 130 may flow through the flow control devices 1219, and when the valves 1200 are in the second position (e.g. during the production phase), 100% of the fluid that enters the housing annulus 141 through the screen 130 may flow through the flow control devices 1219.

The amount of fluid flowing through the openings 152, 1216 (and the gravel pack return openings 126) when the valve 1200 is in the second position may be from about 5% to about 20%, about 10% to about 30%, about 20% to about 50%, or about 5% to about 50% of the amount of fluid flowing through openings 152 (and the gravel pack return openings 126) when the valve 1200 is in the first position. By placing the flow control device 1219 in the valve 1200, the production opening(s) 124 and the flow control device 125 in the base pipe 120 (see FIG. 1A) may be omitted. In another embodiment, the flow control device 312 may be placed in the axial obstruction 310 (see FIG. 3), allowing the production opening(s) 124 and the flow control device 125 in the base pipe 120 (see FIG. 1A) to be omitted.

A shoulder 1211 on the outer surface of the body 1210 may contact a seat 151 on an inner surface of the intermediate tubular member 150 to halt the valve 1200 in the second position. The valve 1200 may be retained in the second position by a latch 1270. The latch 1270 may be coupled to the body 1210 by a hinge. The latch 1270 may be spring-loaded. When the body 1210 moves from the first position to the second position, the spring may kick the latch 1270 radially-outward from the body 1210 such that the latch 1270 engages with the edge of the opening 152 (or another shoulder or recess in the base pipe 120 or housing 140). When this occurs, the latch 1270 may prevent the body 1210 from moving back into the first position.

Figure 14:
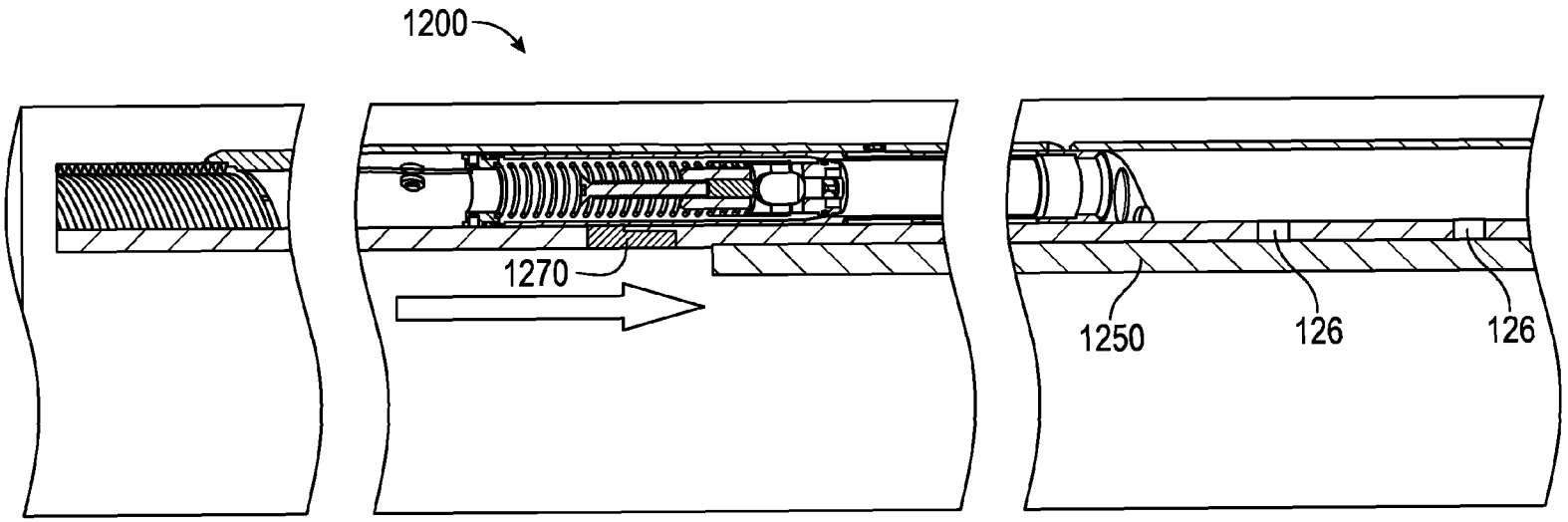
FIG. 14 depicts a cross-sectional view of the portion of the downhole tool shown in FIGS. 12 and 13 with a sliding sleeve preventing fluid flow through one or more openings in the base pipe, according to one or more embodiments disclosed.

FIG. 14 depicts a cross-sectional view of the portion of the downhole tool 100 shown in FIGS. 12 and 13 with an optional sliding sleeve 1250 moved, preventing fluid flow through the gravel pack return openings 126, according to one or more embodiments disclosed. The sliding sleeve 1250 is shown in a first position in FIGS. 12 and 13 where the sliding sleeve 1250 is axially-offset from the gravel pack return openings 126. Thus, fluid may flow through the gravel pack return openings 126. In FIG. 14, the sliding sleeve 1250 has been moved into a second position (e.g., with a shifting tool inside the base pipe 120). In the second position, the sliding sleeve 1250 may prevent fluid flow through the gravel pack return openings 126.

Figure 15:
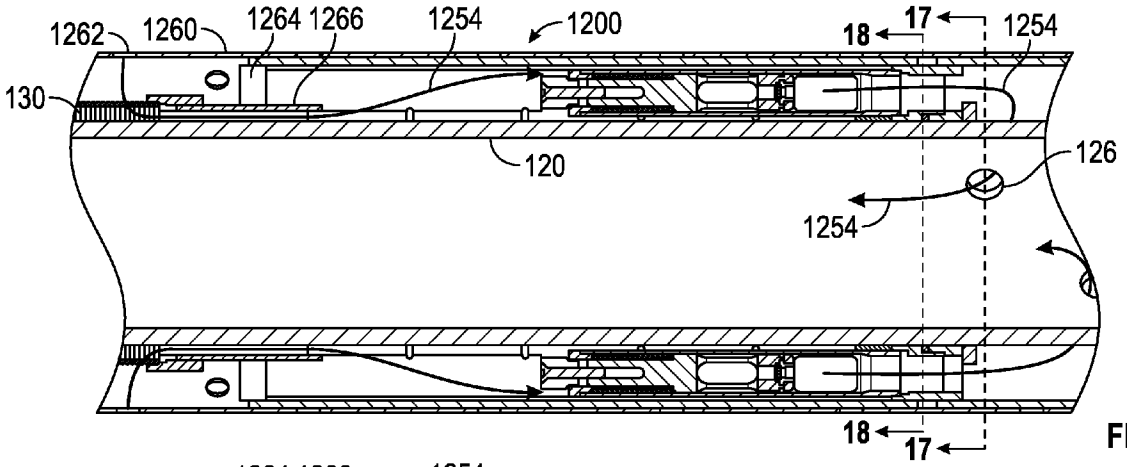
FIG. 15 depicts a partial cross-sectional view of the downhole tool and valve shown in FIG. 12 where the valve is (again) in the first position; however, the screen is positioned radially-closer to the base pipe than as shown in FIG. 12.

FIG. 15 depicts a partial cross-sectional view of the downhole tool 100 and valve 1200 shown in FIG. 12 where the valve 1200 is (again) in the first position; however, the screen 130 is positioned radially-closer to the base pipe 120 than as shown in FIG. 12. When the valve 1200 is in the first position, fluid may follow the path identified with reference number 1254. More particularly, the fluid may flow radially-inward through one or more openings 1262 in an outer shroud 1260. An axial barrier or obstruction 1264 may prevent the fluid from flowing axially therethrough. Thus, the fluid may flow radially-inward through the screen 130. The fluid may then flow axially between a bypass ring 1266 and the base pipe 120. From there, the fluid may follow the same path as shown in FIG. 12. For example, the fluid may flow radially-inward into the intermediate tubular member 150 through the opening 152. The fluid may then flow out of the intermediate tubular member 150 and into the bore 122 of the base pipe 120 though the gravel pack return openings 126 in the base pipe 120.

Figure 16:
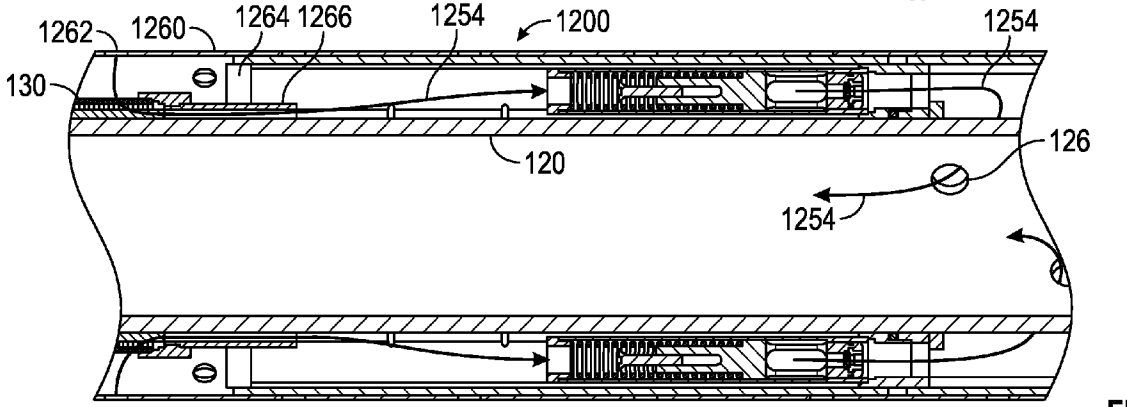
FIG. 16 depicts a partial cross-sectional view of the downhole tool and valve shown in FIG. 13 where the valve is (again) in the second position; however, the screen is positioned radially-closer to the base pipe than as shown in FIG. 13.

FIG. 16 depicts a partial cross-sectional view of the downhole tool 100 and valve 1200 shown in FIG. 13 where the valve 1200 is (again) in the second position; however, the screen 130 is positioned radially-closer to the base pipe 120 than as shown in FIG. 13. When the valve 1200 is in the second position, the fluid may flow radially-inward through the openings 152, 1216 into the axial bore 1218 of the valve 1200. The fluid may then flow through the axial bore 1218 and/or the flow restricting device 1219 and out of the intermediate tubular member 150. From there, the fluid may flow into the base pipe 120 through the gravel pack return openings 126.

Figure 17:
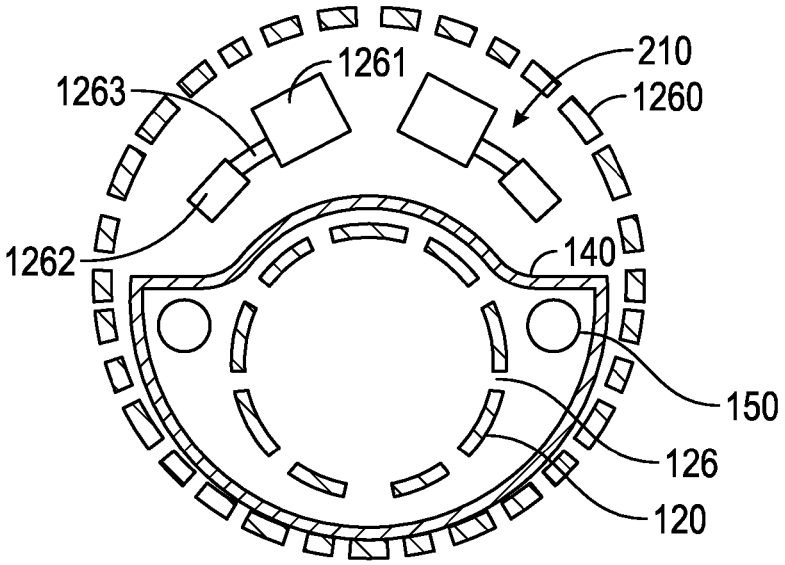
FIG. 17 depicts a cross-sectional view of the downhole tool and the valve taken through line 17-17 in FIG. 15, according to one or more embodiments disclosed.

FIG. 17 depicts a cross-sectional view of the downhole tool 100 and the valve 1200 taken through line 17-17 in FIG. 15, according to one or more embodiments disclosed. FIG. 17 may be similar to FIG. 2, except that the shunt tubes 210 may be positioned radially-outward (e.g., external) from the housing 140. More particularly, the shunt tubes 210 may be positioned radially-between the housing 140 and the shroud 1260. The shunt tubes 1260 may include transport tubes 1261, packing tubes 1262, and a crossover port 1263 positioned therebetween. As shown, the housing 140 may not have a circular cross-section to make room for the external shunt tubes 210. The intermediate tubular members 150 may be positioned radially-between the housing 140 and the base pipe 120.

Figure 18:
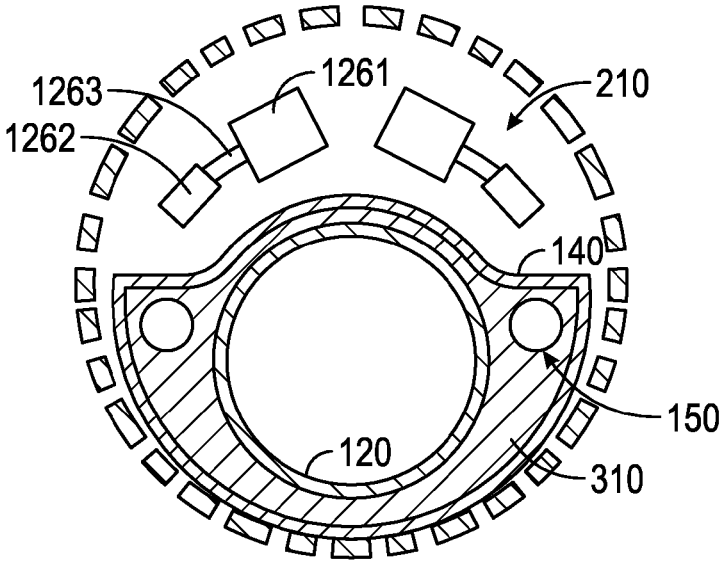
FIG. 18 depicts a cross-sectional view of the downhole tool and the valve taken through line 18-18 in FIG. 15, according to one or more embodiments disclosed.

FIG. 18 depicts a cross-sectional view of the downhole tool 100 and the valve 1200 taken through line 18-18 in FIG. 15, according to one or more embodiments disclosed. FIG. 18 may be similar to FIG. 3, except that the shunt tubes 210 may be positioned radially-outward from the housing 140. The axial obstruction 310 may be positioned radially-between the housing 140 and the base pipe 120. The axial obstruction 310 may prevent fluid from flowing axially through the housing annulus 141, except for the fluid flowing through the intermediate tubular members 150.

Referring now to FIGS. 1-18, in operation, the downhole tool 100 may be run into the wellbore on a drill pipe, a wireline, a coiled tubing, or the like. The downhole tool 100 may be run into the wellbore in a fluid that does not degrade the degradable material (e.g., degradable member 440, degradable member 640, plug 820, cap 1020, or degradable member 1240). This fluid may be, for example, an oil-based fluid. When the downhole tool 100 is in the desired position, the wellbore annulus 162 may be gravel packed prior to actuation of the valve 160, 600, 800, 1000, 1200. To gravel pack the wellbore annulus 162, the gravel slurry may be pumped down the wellbore annulus 162 from the surface.

When the gravel slurry reaches the screen 130, the carrier fluid in the gravel slurry may flow from the wellbore annulus 162, through the screen 130, and into the housing annulus 141. As the valve 160, 600, 800, 1000, 1200 may be in the first position at this time, the fluid may flow radially into the intermediate tubular member 150 through the openings 152, and then flow out of an axial end of the intermediate tubular member 150 and into the bore 122 of the base pipe 120 via the gravel pack return openings 126. From there, the carrier fluid may flow back (up) to the surface.

The gravel particles in the gravel slurry may be too large to pass through the screen 130 and, as a result, may be left in the wellbore annulus 162 proximate the screen 130. In at least one embodiment, the gravel particles may obstruct the portion of the wellbore annulus 162 outside the screen 130 such that the gravel slurry may not be able to flow to any subsequent completion assemblies. When this occurs, the gravel slurry may flow through one or more shunt tubes 210 (see FIGS. 2, 3, 17, 18) to bypass the "packed" or "bridged" portion of the wellbore annulus 162 outside the screen 130.

Once the gravel packing has taken place, the degradable material (e.g., degradable member 440, degradable member 640, plug 820, cap 1020, or degradable member 1240) may degrade or dissolve due to contact with a fluid in the wellbore (e.g., a gravel packing fluid, a spacer fluid, a water-based fluid, etc.) for a predetermined amount of time. As mentioned above, the fluid that causes the degradable material to degrade or dissolve may be or include water, formation fluid (e.g., hydrocarbons), gravel pack carrier fluid, an additive that is pumped downhole (e.g., circulated or "spotted as a pill"), or a combination thereof. The valve 160, 600, 800, 1000, 1200 may move from the first position to the second position in response to the degradable material at least partially degrading or dissolving. In another embodiment, the valve 160, 600, 800, 1000, 1200 may move from the first position to the second position in response to an expandable (e.g., swellable) material expanding due to contact with the fluid in the wellbore for a predetermined amount of time.

In at least one embodiment, when in the second position, the valve 160, 600, 800, 1000 may prevent fluid from flowing from the screen 130 to the gravel pack return openings 126 (i.e., the valve 160, 600, 800, 1000 may obstruct the flowpath 154). In another embodiment, the valve 1200, when in the second position, may reduce or restrict the fluid flow (while still allowing some flow) from the screen 130 to the gravel pack return openings 126.

Once the valve 160, 600, 800, 1000, 1200 has moved to the second position, production from the surrounding formation 104 may begin. Hydrocarbon fluids may flow into the wellbore annulus 162 from the formation 104. The hydrocarbon fluids may be filtered by the gravel particles and the screen 130 as they flow into the housing annulus 141. When the flowpath 154 to the gravel pack return openings 126 is obstructed by the valve 160, 600, 800, 1000, the hydrocarbon fluids may flow through the production opening(s) 124 to the bore 122 of the base pipe 120. In another embodiment, when the valve 1200 includes the flow control device (e.g., nozzle) 1219, the fluid may continue to flow through the valve 1200 and into the bore 122 of the base pipe 120 through the gravel pack return openings 126. As noted above, the production opening(s) 124 and the flow control device(s) 125 may be omitted in the embodiment utilizing valve 1200. As mentioned above, in at least one embodiment, the flow control device 312 may provide a flowpath through the barrier 310 (see FIG. 3), allowing the production opening(s) 124 and the flow control device(s) 125 to be omitted.

In addition to gravel packing operations, the valve 160, 600, 800, 1000, 1200 may also be used during injection operations, which take place after gravel packing operations and when the valve 160, 600, 800, 1000, 1200 is in the second position. The valve 160, 600, 800, 1000, 1200 and/or the intermediate tubular member 150 may be rotated 180° for injection operations. In other words, an inlet (e.g., opening 152) of the valve 160, 600, 800, 1000, 1200 may be positioned proximate to the gravel pack return openings 126, and an outlet of the valve 160, 600, 800, 1000, 1200 may be positioned proximate to the screen 130. When positioned in this manner, the valve 160, 600, 800, 1000, 1200 may obstruct or restrict fluid flow from the gravel pack return openings 126 to the screen 130.

More particularly, an injection fluid (e.g., water, steam, spotting a pill, etc.) may be pumped into the base pipe 120 from the surface location. The injection fluid may flow into the housing annulus 141 through the gravel pack return openings 126. The injection fluid may flow axially through the housing annulus 141 until further flow is prevented by the axial obstruction 310. The injection fluid may then flow into the intermediate tubular member 150 through the openings 152, and the injection fluid may flow from the intermediate tubular member 150 through the screen 130 to the wellbore or casing annulus 162.

Figure 19:
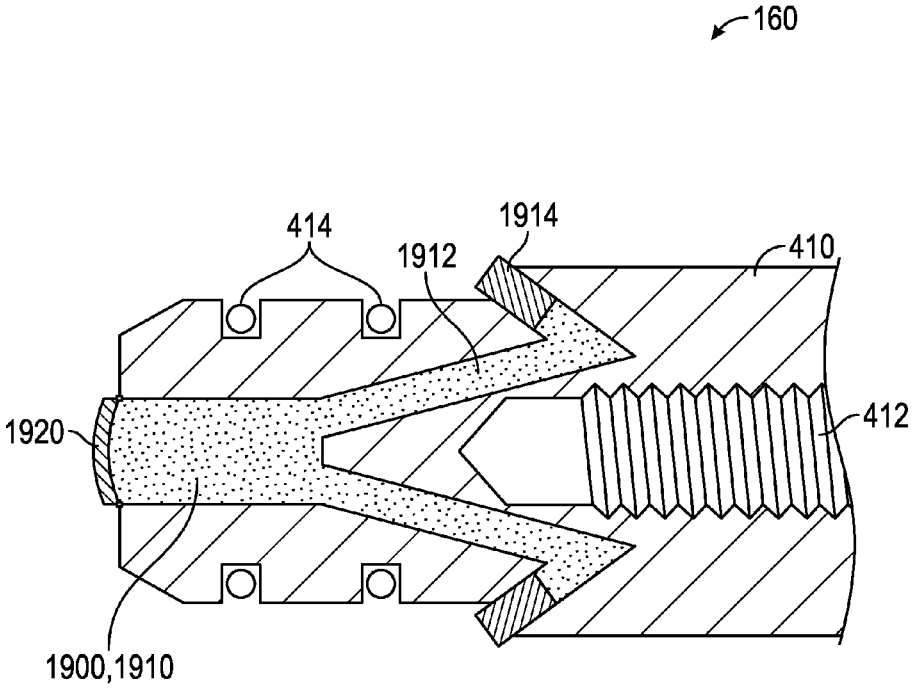
FIG. 19 depicts a cross-sectional view of a portion of the valve shown in FIG. 4 with a tracer material disposed therein, according to one or more embodiments disclosed.

FIG. 19 depicts a cross-sectional view of a portion of the valve of FIGS. 1, 4, and 5 showing a tracer material 1900 disposed therein, according to one or more embodiments disclosed. Although the valve 160 from FIGS. 1, 4, and 5 is depicted, it will be appreciated that the tracer material 1900 may be disposed in the valve 600 in FIGS. 6 and 7, in the valve 800 in FIGS. 8 and 9, in the valve 1000 in FIGS. 10 and 11.

The tracer material 1900 may be stored in an interior volume 1910 in the body 410 of the valve 160. A frangible material, such as a rupture disk 1920, may be positioned over an outer surface (e.g., an outer axial surface) of the body 410 to contain the tracer material 1900 therein. The interior volume 1910 may include one or more channels 1912 that provide a path of fluid communication to an outer radial surface of the body 410. A plunger 1914 may be at least partially disposed within each channel 1912 proximate the outer radial surface of the body 410.

Figure 20:
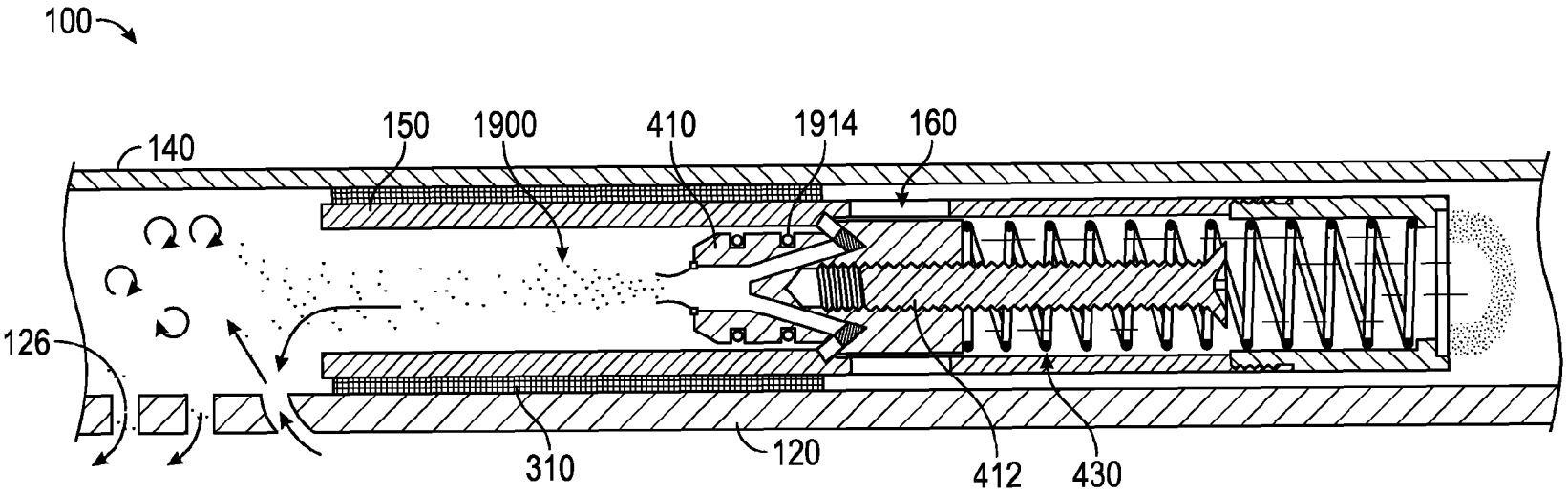
FIG. 20 depicts a cross-sectional view of a portion of the downhole tool shown in FIG. 4 where the tracer material has been released to indicate that the opening is obstructed by the valve, according to one or more embodiments disclosed.

FIG. 20 depicts a cross-sectional view of a portion of the downhole tool 100 where the tracer material 1900 has been released to indicate that the opening 152 is obstructed by the valve 160, according to one or more embodiments disclosed. As the valve 160 moves from the first position to the second position, an outer radial surface of the valve 160 may contact an inner radial surface of the intermediate tubular member 150 (e.g., the shoulder 151), which may stop the valve 160 in the second position. The contact may push the plungers 1914 further into the channels 1912. This force may cause the rupture disk 1920 to rupture, releasing the tracer material 1900. The tracer material 1900 may flow up to the surface as an indicator that the opening 152 in the intermediate tubular member 150 is obstructed and the flow path 154 (see FIG. 1A) through the gravel pack return openings 126 is blocked off. The tracer material 1900 may have a chemical signature and/or color that is recognizable at the surface. In at least one embodiment, each valve 160 may have a unique tracer material to that identifies a particular valve 160.

Figure 21:
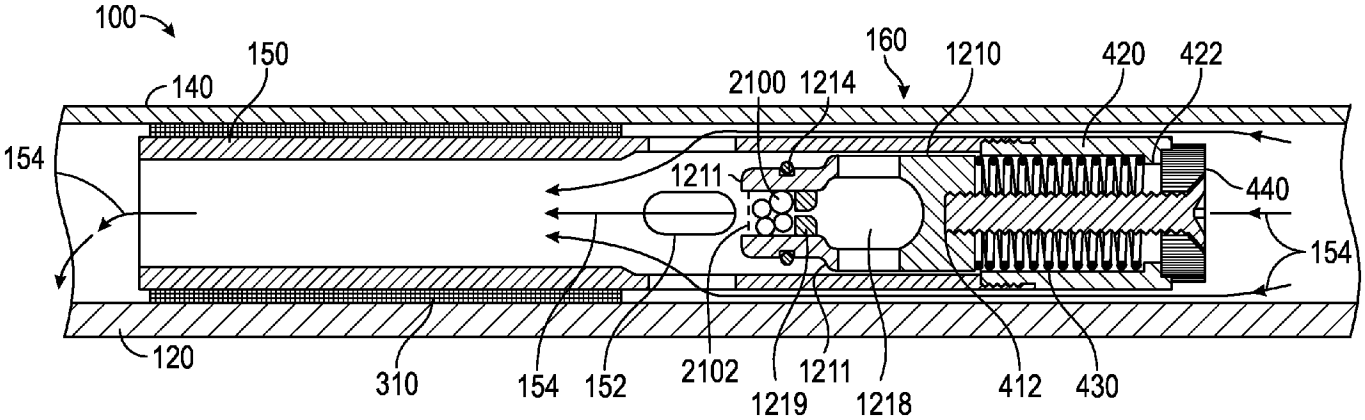
FIG. 21 depicts a cross-sectional view of a portion of the valve of FIGS. 12 and 13 showing a tracer material disposed therein, according to one or more embodiments disclosed.

FIG. 21 depicts a cross-sectional view of a portion of the valve 1200 of FIGS. 12 and 13 showing a tracer material 2100 disposed therein, according to one or more embodiments disclosed. The tracer material 2100 may be disposed within the axial bore 1218 in the body 1210 of the valve 1200. As shown, the tracer material 2100 may be positioned between a leading end of the body 1210 and the flow restricting device 1219. The tracer material 2100 may be held in place by layer 2102 that is frangible, dissolvable, degradable, or the like. For example, the layer 2102 may be made of any of the materials listed above for the degradable member 440. The tracer material 2100 may be in the form of one or more balls (e.g., spheres) that are released and produced to the surface when the layer 2102 breaks, dissolves, or degrades.

Figure 22:
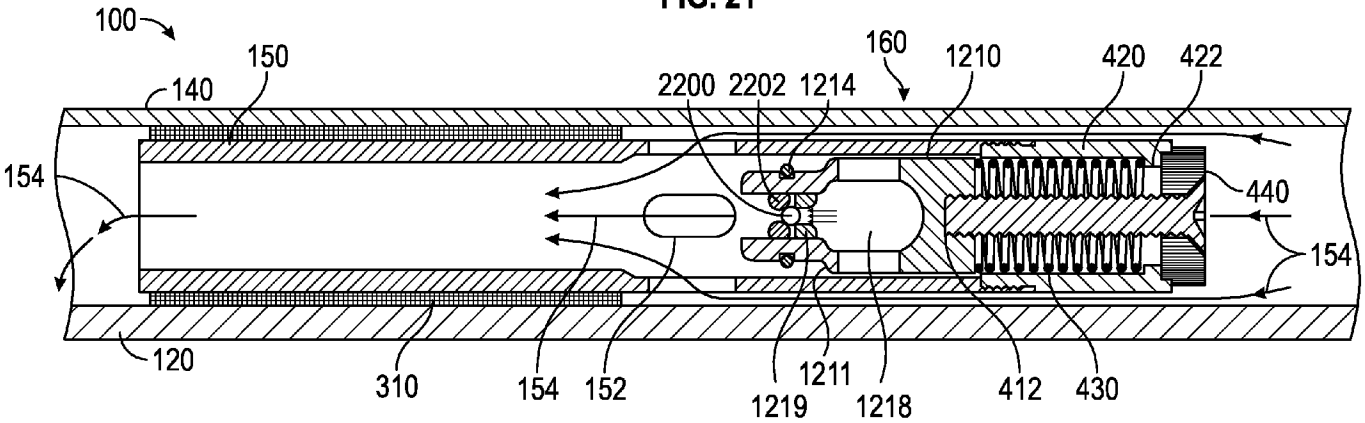
FIG. 22 depicts a cross-sectional view of a portion of the valve of FIGS. 12 and 13 showing another tracer material disposed therein, according to one or more embodiments disclosed.

FIG. 22 depicts a cross-sectional view of a portion of the valve 1200 of FIGS. 12 and 13 showing another tracer material 2200 disposed therein, according to one or more embodiments disclosed. The tracer material 2200 may be disposed within the axial bore 1218 in the body 1210 of the valve 1200. As shown, the tracer material 2200 may be positioned between the leading end of the body 1210 and the flow restricting device 1219. More particularly, the tracer material 2200 may be positioned between one or more retaining upsets 2202 and the flow restricting device 1219.

The retaining upset(s) 2202 may be coupled to or integral with the inner surface of the body 1210 that defines the axial bore 1218. In one embodiment, the retaining upset(s) 2202 may be or include an annular ring that is at least partially disposed within an annular recess formed in the inner surface of the body 1210. The retaining upset(s) 2202 may be made of a flexible material (e.g., rubber) that may bend or flex to allow the tracer material 2200 to pass therethrough when the valve 1200 is in the second position where the fluid flows through the flow restricting device 1219 and pushes the tracer material 2200 (e.g., to the left as shown in FIG. 22). The inner diameter of the retaining upset(s) 2202 may be less than, equal to, or greater than the inner diameter of the flow restricting device 1219.

Figure 23:
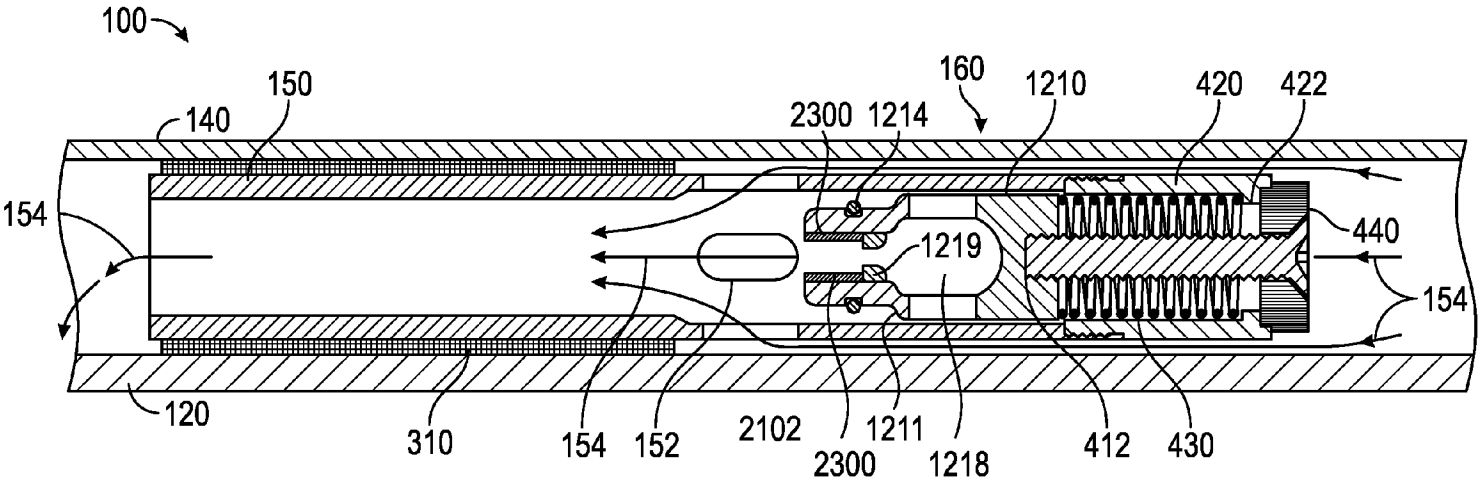
FIG. 23 depicts a cross-sectional view of a portion of the valve of FIGS. 12 and 13 showing another tracer material disposed therein, according to one or more embodiments disclosed.

FIG. 23 depicts a cross-sectional view of a portion of the valve 1200 of FIGS. 12 and 13 showing another tracer material 2300 disposed therein, according to one or more embodiments disclosed. The tracer material 2300 may be disposed within the axial bore 1218 in the body 1210 of the valve 1200. As shown, the tracer material 2300 may be positioned between the leading end of the body 1210 and the flow restricting device 1219. In another embodiment, the tracer material 2300 may be positioned upstream of the flow restricting device 1219 More particularly, the tracer material 2300 may be in the form of an annular ring or sleeve that releases a chemical signature when in contact with one or more fluids in the wellbore for a predetermined amount of time. For example, the tracer material 2300 may release a chemical signature when placed in contact with a hydrocarbon fluid during production.

Figure 24:
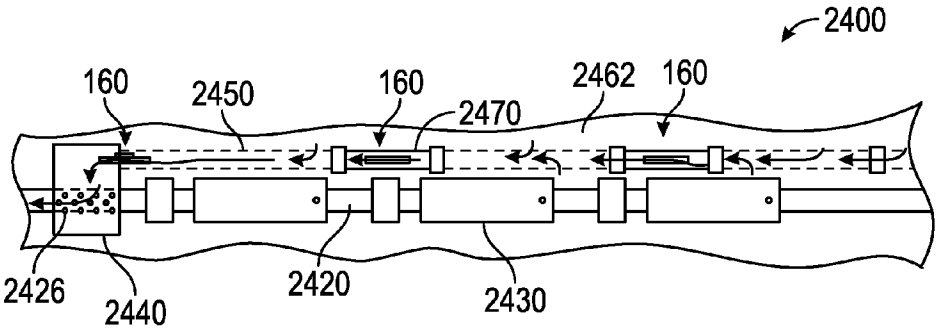
FIG. 24 depicts a partial cross-sectional view of an illustrative downhole tool including a dehydration tube, according to one or more embodiments disclosed.

FIG. 24 depicts a partial cross-sectional view of an illustrative downhole tool 2400 including a dehydration tube 2450, according to one or more embodiments disclosed. The dehydration tube 2450 may be positioned radially-outward from the base pipe 2420 and the screen 2430. One or more openings may be formed radially through the dehydration tube 2450.

During gravel packing operations, the gravel slurry may be pumped down the wellbore or casing annulus 2462 from the surface location. While the gravel particles become packed in the wellbore or casing annulus 2462, the carrier fluid may flow into the dehydration tube 2450. The carrier fluid may flow through the dehydration tube 2450 and into the base pipe 2420 through the gravel pack return openings 2426 in the gravel pack return housing 2440. Although a single gravel pack return housing 2440 is shown for multiple sections of screen 2430 or section of base pipe 2420, it will be appreciated that one or more gravel pack return housings 2440 may be used for each screen or segment of base pipe 2420.

Once gravel packing operations are complete, the flowpath through the dehydration tube 2450 may be obstructed to prevent formation fluids from flowing therethrough. This may be accomplished by inserting one or more valves 160 into the dehydration tube 2450. Although the valve 160 is shown, it may be appreciated that any of valves 600, 800, 1000, 1200 may also be used. As discussed above, the valves 160, 600, 800, 1000, 1200 may be actuated from the first position to the second position by degradation of a degradable member or by expansion of a swellable member. When the valves 160 move from the first position to the second position, the valves 160 may prevent fluid (e.g., hydrocarbons) from flowing axially through the dehydration tube 2450. This may restrict fluid flow from the dehydration tube 2450 to the screen 2430 and/or prevent flow between two sections of the dehydration tube 2450.

One or more jumpers 2470 may be coupled to the dehydration tube 2450. The jumpers 2470 may be installed on the rig floor to connect dehydration tubes 2450 on adjacent joints. As shown, a valve 160 may be disposed within the jumper 2470 to prevent fluid communication through the inner diameter of the dehydration tube 2450. In another embodiment, the valve 160 may be installed in the dehydration tube 2450 that runs along the screen 2430.

Figure 25:
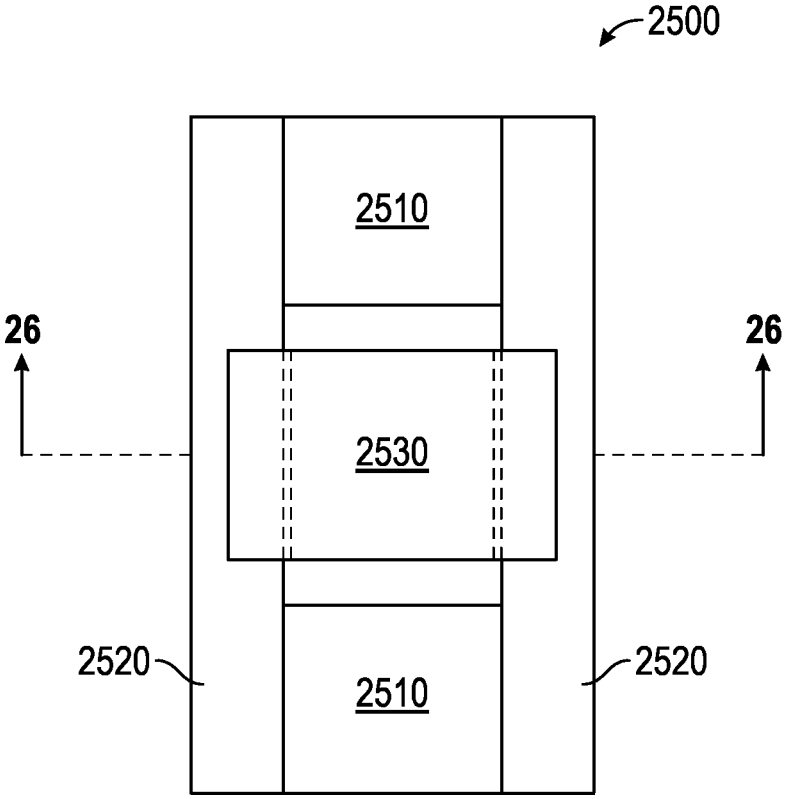
FIG. 25 depicts a partial cross-sectional view of an illustrative valve in a first position, according to one or more embodiments disclosed.

FIG. 25 depicts a partial cross-sectional view of another illustrative valve 2500 in a first position, according to one or more embodiments disclosed. Instead of, or in addition to, a degradable member (e.g., degradable member 440 in FIG. 4), the valve 2500 may include one or more swellable members (two are shown: 2510). The swellable members 2510 may be positioned at least partially between opposing plates 2520. A shaft 2530 may also be positioned between the plates 2520. As shown, the shaft 2530 may also be positioned between the swellable members 2510.

Figure 26:
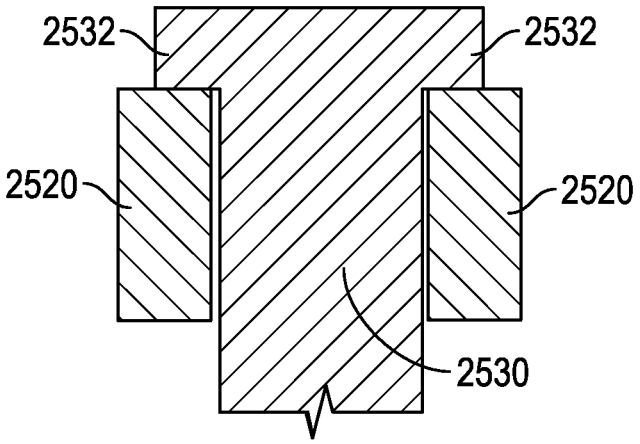
FIG. 26 depicts a cross-sectional view of the valve shown in FIG. 25 taken through lines 26-26, according to one or more embodiments disclosed.

FIG. 26 depicts a cross-sectional view of the valve 2500 shown in FIG. 25 taken through lines 26-26, according to one or more embodiments disclosed. The shaft 2530 may include one or more shoulders (two are shown: 2532) that are configured to contact the plates 2520 and prevent axial movement of the shaft 2530 when the valve 2500 is in the first position.

Figure 27:
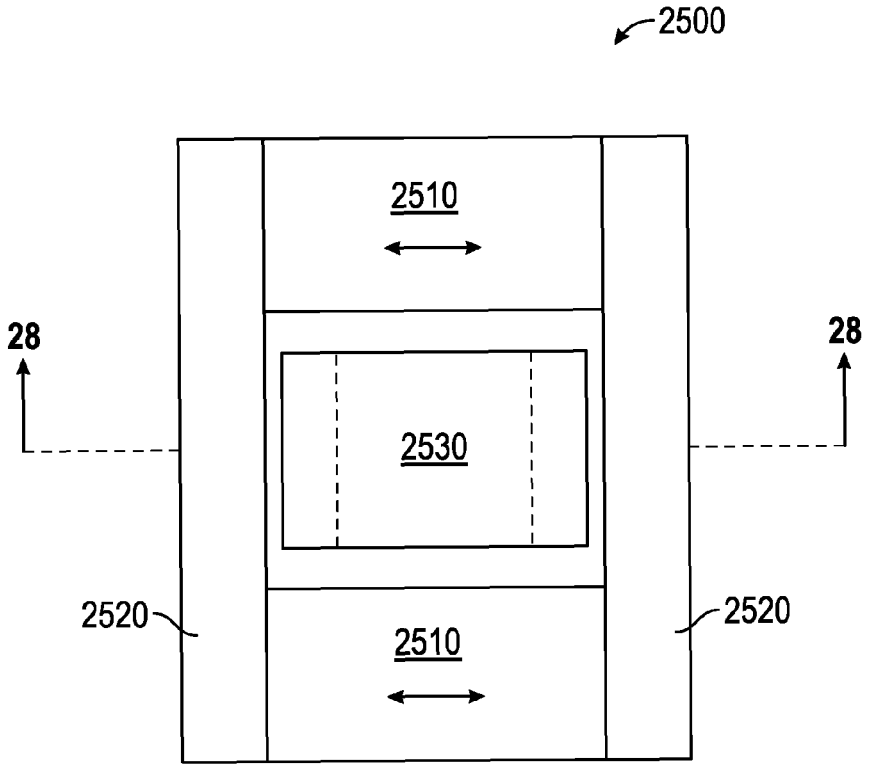
FIG. 27 depicts a partial cross-sectional view of the valve shown in FIG. 25 in a second position, according to one or more embodiments disclosed.

FIG. 27 depicts a partial cross-sectional view of the valve 2500 shown in FIG. 25 in a second position, according to one or more embodiments disclosed. When the swellable members 2510 are exposed to a fluid for a predetermined amount of time, the swellable members 2510 may swell (i.e., expand), thereby pushing the plates 2520 away from one another. The plates 2520 may not swell or degrade in response to contact with the fluid. In at least one embodiment, the plates 2520 may be made of a degradable material, and the swellable members 2510 may be used in combination with the degradable plates 2520. As such, if the degradation is not complete before production begins, the swellable members 2510 may push the partially degraded plates 2520 to induce the triggering.

Figure 28:
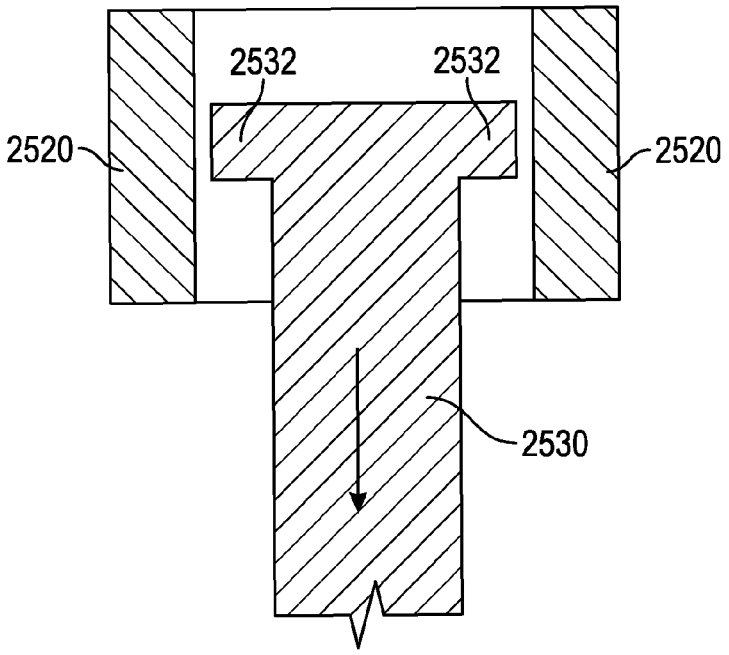
FIG. 28 depicts a cross-sectional view of the valve in FIG. 27 taken through lines 28-28, according to one or more embodiments disclosed.

FIG. 28 depicts a cross-sectional view of the valve 2500 in FIG. 27 taken through lines 28-28, according to one or more embodiments disclosed. Once the plates 2520 move away from one another, the inner diameter of the plates 2520 may become greater than the outer diameter of the shoulders 2532 of the shaft 2530. This may enable the shaft 2530 to move axially with respect to the plates 2520 (e.g., in response to a force exerted by a biasing member), thereby actuating the valve 2500 into the second position.

In at least one embodiment, a method for gravel packing a wellbore may include degrading a degradable member (e.g., member 1240) in a downhole tool 100. The downhole tool 100 may include a screen 130 and a valve 1200. The valve 1200 may be actuated in response to the degradable member 1240 at least partially degrading. This may change a proportion of the fluid that flows through a flow control device (e.g., 1219) of the overall fluid that flows through the screen 130. The wellbore may be gravel packed prior to actuating the valve 1200. Gravel packing operations may involve pumping downhole a gravel pack carrier fluid including gravel slurry. The gravel pack carrier fluid may be a water-based fluid or an oil-based fluid. Hydrocarbons may be produced from the wellbore after the valve 1200 is actuated. The downhole tool 100 may be run into the wellbore in a fluid that does not degrade the degradable member 1200. For example, the fluid may be an oil-based fluid or a water-based fluid. In some embodiments, the downhole tool 100 is run-in-hole in the same fluid which is used to drill the wellbore or a base fluid the having the same polarity as the drilling fluid. In another embodiment, the downhole tool 100 may be run into the wellbore in a fluid that does degrade the degradable member 1200, but the gravel packing operations take place before the fluid degrades the degradable member 1240 sufficiently to actuate the valve 1200. The degradable member 1240 may be degraded after contacting an oil-based fluid, a water-based fluid, a gravel packing fluid, or a spacer fluid. In one embodiment, the degradable member 1240 may be degradable in oil or water. In one example, the downhole tool 100 may be run into the wellbore in a first fluid, and the wellbore may be gravel packed with a second fluid. One of the first fluid and the second fluid may be an oil-based fluid, and the other of the first fluid and the second fluid may be a water-based fluid. At least one of the first fluid and the second fluid are capable of degrading the member 1240. In other embodiments, the first fluid or second fluid may be a spacer fluid introduced into the wellbore between the drilling fluid and the gravel packing fluid. In another embodiment, a spacer fluid may be used to degrade the degradable member 1240. In yet another embodiment, the method may include spotting a pill of fluid at the downhole tool 100 to degrade the degradable member 1240. Additionally, embodiments of degrading the degradable member 1240 may include using a degradable material that may be degraded by the production fluids from the formation. For example, the wellbore may be drilled with a water-based fluid and gravel packed with water-based fluid, and the production fluids may cause the degradable material to degrade, thereby causing the downhole tool 100 to actuate. Finally, some embodiments may include adding a component to any one of the fluids pumped into the wellbore that promote or retard degradation of the degradable member 1240.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although the preceding description has been described herein with reference to particular means, materials, and embodiments, it is not intended to be limited to the particulars disclosed herein; rather, it extends to all functionally equivalent structures, methods, and uses, such as are contemplated within the scope of the appended claims. While the foregoing is directed to embodiments of the present invention, other and further embodiments of the invention may be devised without departing from the basic scope thereof.

What is claimed is:

1. A downhole tool, comprising:

a housing comprising a screen;

an inner tubular member positioned radially-inward from the housing such that an annulus is formed therebetween, wherein a first opening is formed radially-through the inner tubular member;

a valve positioned within the annulus;

a flow control device positioned within the annulus; and a degradable member configured to at least partially degrade in response to contact with a fluid, wherein the valve is configured to actuate from a first position to a second position in response to the degradable member at least partially degrading, thereby changing a proportion of the fluid that flows through the flow control device after entering through the screen, wherein the valve comprises:

an intermediate tubular member positioned within the annulus, wherein a second opening is formed radially-through the intermediate tubular member; and a body positioned at least partially within the intermediate tubular member, wherein a third opening is formed radially-through the body.

2. The downhole tool of claim 1, further comprising a biasing member configured to actuate the valve from the first position to the second position when the degradable member at least partially degrades.

3. The downhole tool of claim 2, wherein the second and third openings are offset from one another when the valve is in the first position, and wherein the second and third openings are aligned when the valve is in the second position.

4. The downhole tool of claim 3, wherein a first flowpath exists from the screen, through the second opening, and to the first opening, bypassing the flow control device, when the valve is in the first position, and wherein a second flowpath exists from the screen, through the second and third openings and the flow control device, and to the first opening when the valve is in the second position.

5. The downhole tool of claim 3, wherein the flow control device is positioned within a bore that extends at least partially through the body.

6. The downhole tool of claim 1, wherein the flow control device comprises an inflow control device.

7. The downhole tool of claim 1, wherein the flow control device comprises a nozzle.

8. The downhole tool of claim 1, further comprising a shunt tube positioned radially-inward from the housing.

9. The downhole tool of claim 1, further comprising a shunt tube positioned radially-outward from the housing.

10. A downhole tool, comprising:

a housing comprising a screen;

an inner tubular member positioned radially-inward from the housing such that an annulus is formed therebetween, wherein a first opening is formed radially-through the inner tubular member;

a valve positioned within the annulus between the screen and the first opening, wherein the valve comprises:

an intermediate tubular member having a second opening formed radially-therethrough; and a body positioned at least partially within the intermediate tubular member, wherein a third opening is formed radially-through the body;

a flow control device positioned within the body; and a degradable member configured to at least partially degrade in response to contact with a fluid, wherein the valve is configured to actuate from a first position to a second position in response to the degradable member at least partially degrading, thereby changing a proportion of the fluid that flows through the flow control device after flowing through the screen.

11. The downhole tool of claim 10, wherein the body comprises a shaft that is coupled to the degradable member when the valve is in the first position.

12. The downhole tool of claim 11, wherein the valve further comprises a biasing member configured to actuate the valve from the first position to the second position when the degradable member at least partially degrades.

13. The downhole tool of claim 12, the biasing member is positioned at least partially around the shaft.

14. The downhole tool of claim 13, wherein the valve comprises a tracer material that is released after the valve actuates into the second position.

15. A method for gravel packing a wellbore, comprising:

providing a downhole tool with a housing having a screen, an inner tubular member positioned radially inward from the housing, a flow control device positioned to control fluid flow into an interior of the inner tubular member, and a valve held in a first operational position via a degradable member, the valve being positioned in an annulus between the housing and the inner tubular member;

degrading the degradable member in the downhole tool;

actuating the valve in response to the degradable member at least partially degrading to release a spring-loaded valve body, thus blocking at least a portion of fluid flow through the valve; and changing a proportion of fluid that flows through the flow control device, after entering through the screen, by actuating the valve via the at least partially degrading of the degradable member.

16. The method of claim 15, further comprising gravel packing the wellbore prior to actuating the valve.

17. The method of claim 15, further comprising producing hydrocarbons from the wellbore after the valve is actuated.

18. The method of claim 15, further comprising running the downhole tool into the wellbore in a fluid that does not degrade the degradable member.

19. The method of claim 18, further comprising running the downhole tool into the wellbore in an oil-based fluid.

20. The method of claim 15, further comprising degrading the degradable member with a gravel packing fluid.

21. The method of claim 15, further comprising running the downhole tool into the wellbore in a spacer fluid or degrading the degradable member with a spacer fluid.

22. The method of claim 15, further comprising degrading the degradable member with a water-based fluid.

23. The method of claim 15, further comprising running the downhole tool into the wellbore in a first fluid and gravel packing the wellbore with a second fluid, wherein one of the first fluid and the second fluid is an oil-based fluid, and the other of the first fluid and the second fluid is a water-based fluid.

24. The method of claim 15, wherein the downhole tool further comprises:

a first opening formed radially-through the inner tubular member, wherein the valve is positioned between the screen and the first opening, and wherein the valve comprises:

an intermediate tubular member having a second opening formed radially-therethrough; and the spring-loaded valve body positioned at least partially within the intermediate tubular member, wherein a third opening is formed radially-through the spring-loaded valve body;

the flow control device being positioned within the spring-loaded valve body; and wherein the degradable member is configured to at least partially degrade in response to contact with a fluid, wherein the valve is configured to actuate from a first position to a second position in response to the degradable member at least partially degrading.

* * * * *